US012226030B1

(12) United States Patent
Marenco et al.

(10) Patent No.: US 12,226,030 B1
(45) Date of Patent: Feb. 18, 2025

(54) FLEX-BACK BANQUET CHAIR

(71) Applicant: NPS Public Furniture Corp., Clifton, NJ (US)

(72) Inventors: Maria Candela Calvo Marenco, Alicante (ES); Jose Ignacio Herenu, Alicante (ES)

(73) Assignee: NPS Public Furniture Corp., Clifton, NJ (US)

( * ) Notice: Subject to any disclaimer, the term of this patent is extended or adjusted under 35 U.S.C. 154(b) by 0 days.

(21) Appl. No.: 18/939,736

(22) Filed: Nov. 7, 2024

(51) Int. Cl.

| | |
|---|---|
| ***A47C 3/04*** | (2006.01) |
| ***A47C 7/28*** | (2006.01) |
| ***A47C 7/30*** | (2006.01) |
| ***A47C 7/44*** | (2006.01) |

(52) U.S. Cl.
CPC ..... *A47C 7/44* (2013.01); *A47C 3/04* (2013.01); *A47C 7/445* (2013.01); *A47C 7/285* (2013.01)

(58) Field of Classification Search
CPC ..... A47C 3/04; A47C 7/285; A47C 7/44; A47C 7/445
See application file for complete search history.

(56) References Cited

U.S. PATENT DOCUMENTS 3,114,578 A * 12/1963 Hamilton ..... A47C 7/028 297/440.2 X
4,580,836 A * 4/1986 Verney ..... A47C 7/445 297/296 X
4,603,904 A * 8/1986 Tolleson ..... A47C 7/44 297/285
4,830,430 A * 5/1989 Schafer ..... A47C 7/445 297/296 X
4,869,552 A * 9/1989 Tolleson ..... A47C 7/445 297/296 X
4,938,532 A * 7/1990 Burgess ..... A47C 7/445 297/291 X (Continued)

FOREIGN PATENT DOCUMENTS

WO WO-9832357 A1 * 7/1998 ..... A47C 7/285

OTHER PUBLICATIONS

"Oxford Stack Chair," https://princeseating.furniture/collections/chairs/products/oxford-stack-chair, Prince Seating, Retrieved on Jun. 26, 2024.

(Continued)

*Primary Examiner* — Rodney B White
(74) *Attorney, Agent, or Firm* — Weiss & Arons LLP

(57) ABSTRACT

Apparatus, methods and systems for a flex-back banquet chair are provided. The chair may include a flex bracket. The flex bracket may include sheet metal that is bent at an angle. The flex bracket may include a first mounting space extending in a first direction and a second mounting space. The flex bracket may include three nerves, each nerve including an indentation in the sheet metal. Each nerve may extend from a bottom edge of the first mounting space in a direction that is orthogonal to the first direction. When the first mounting space is mounted to a back side of the chair and the second mounting space is mounted on the underside the chair, a backboard frame together with the first mounting space may recline, in response to a force applied to the backboard frame, about a junction of a base frame and the second mounting space.

20 Claims, 28 Drawing Sheets

(56) References Cited

U.S. PATENT DOCUMENTS

| | | | | | |
|---|---|---|---|---|---|
| 5,039,163 | A * | 8/1991 | Tolleson | A47C 7/445 | 297/297 |
| 5,902,012 | A * | 5/1999 | Han | A47C 7/44 | 297/285 |
| 6,406,096 | B1 * | 6/2002 | Barile, Sr. | A47C 7/445 | 297/296 X |
| 6,471,293 | B2 * | 10/2002 | Ware | A47C 7/445 | 297/285 |
| 6,533,352 | B1 * | 3/2003 | Glass | A47C 7/445 | 297/291 X |
| 6,679,551 | B2 * | 1/2004 | Ware | A47C 7/445 | 297/285 |
| 6,715,838 | B1 * | 4/2004 | Pflaster | A47C 4/028 | 297/239 X |
| 6,820,934 | B2 * | 11/2004 | Ware | A47C 7/445 | 297/285 |
| 6,896,327 | B1 * | 5/2005 | Barile, Sr. | A47C 7/445 | 297/285 |
| 7,014,268 | B2 * | 3/2006 | Socha, Jr. | A47C 3/04 | 297/239 X |
| 8,388,064 | B2 * | 3/2013 | Bertolini | A47C 7/445 | 297/285 |
| 9,004,596 | B2 * | 4/2015 | Barile, Jr | A47C 3/04 | 297/297 |
| 9,072,384 | B2 * | 7/2015 | Saint Pierre | A47C 3/04 | |
| 9,295,332 | B2 * | 3/2016 | Barile | A47C 7/021 | |
| 9,392,872 | B2 * | 7/2016 | Saint Pierre | A47C 3/00 | |
| 9,414,683 | B2 * | 8/2016 | Barile | A47C 3/04 | |
| 9,986,839 | B2 * | 6/2018 | Pectol | A47C 7/445 | |
| 10,588,414 | B2 * | 3/2020 | Olarte | A47C 5/06 | |
| 10,835,045 | B2 * | 11/2020 | Olarte | A47C 3/04 | |
| 11,457,744 | B2 * | 10/2022 | Olarte | A47C 1/124 | |
| 2010/0066140 | A1 * | 3/2010 | Ware | A47C 3/04 | 297/239 |
| 2011/0278889 | A1 * | 11/2011 | Sienkowski | A47C 3/04 | 297/239 X |
| 2013/0187422 | A1 * | 7/2013 | Schwinghammer | A47C 7/44 | 297/239 X |
| 2018/0098634 | A1 * | 4/2018 | Smith | A47C 7/62 | |
| 2018/0368577 | A1 * | 12/2018 | Prock | A47C 7/002 | |
| 2023/0284784 | A1 * | 9/2023 | Piretti | A47C 3/12 | |

OTHER PUBLICATIONS

"Ella Flex Back Stackable Aluminum Banquet Chair," https://www.superiorseating.com/ella-upholstered-stackable-aluminum-banquet-chair, Superior Seating, Retrieved on Jun. 26, 2024.

"Horizon Banquet Chair," https://mitylite.com/products/chairs/horizon-banquet-chair, MityLite, Retrieved on Jun. 26, 2024.

* cited by examiner

Section 12-12

FLEX-BACK BANQUET CHAIR

FIELD OF TECHNOLOGY

Aspects of the disclosure relate to functional mechanical designs and apparatus. Specifically, aspects of the disclosure relate to banquet chairs with improved reclining.

BACKGROUND OF THE DISCLOSURE

Banquet chairs are generally used in formal occasions, such as gatherings, conferences and weddings. At most of these occasions, users tend to sit for a prolonged period of time. Typically, banquet chairs tend to be non-flexible, and after the prolonged period of time, may be uncomfortable for the users.

Current solutions for adding flexibility to banquet chairs include using L-shaped brackets to connect the back of the banquet chair to the base of the banquet chair. The L-shaped brackets are generally made out of aluminum because of aluminums durability. Although the L-shaped aluminum brackets enable flexing, increased flexing may cause the L-shaped aluminum bracket to bend or break. Alternatively, L-shaped brackets formed from other materials, such as steel, may not have enough give to enable a desired amount of flexibility.

It would therefore be desirable to provide apparatus, systems and methods for a flex-back banquet chair with improved durability and increased flexibility.

SUMMARY OF THE DISCLOSURE

Apparatus, methods and systems for a flex-back banquet chair are provided.

The flex-back banquet chair may include a flex bracket. The flex bracket may include sheet metal. The sheet metal may be bent at an angle. The flex bracket may include a first mounting space. The first mounting space may extend along the sheet metal in a first direction. The flex bracket may include a second mounting space.

The flex bracket may include three nerves. Each nerve may include an indentation in the sheet metal. Each nerve may extend from a bottom edge of the first mounting space in a second direction. The second direction may be orthogonal to the first direction.

The first mounting space may be welded onto a back side of a backboard frame of the flex-back banquet chair. The second mounting space may be screwed onto an underside of a base frame of the flex-back banquet chair.

When the first mounting space is mounted to the back side of the backboard frame and the second mounting space is screwed to the underside of the base frame, the backboard frame together with the first mounting space may recline. The backboard frame together with the first mounting space may recline in response to a force applied to the backboard frame. The backboard frame together with the first mounting space may recline about a junction of the base frame and the second mounting space.

BRIEF DESCRIPTION OF THE DRAWINGS

The objects and advantages of the disclosure will be apparent upon consideration of the following detailed description, taken in conjunction with the accompanying drawings, in which like reference characters refer to like parts throughout, and in which:

FIG. 21B shows a cross-sectional view along the view lines 21-21;

FIG. 24B shows a cross-sectional view along the view lines 24-24;

Figure 1:
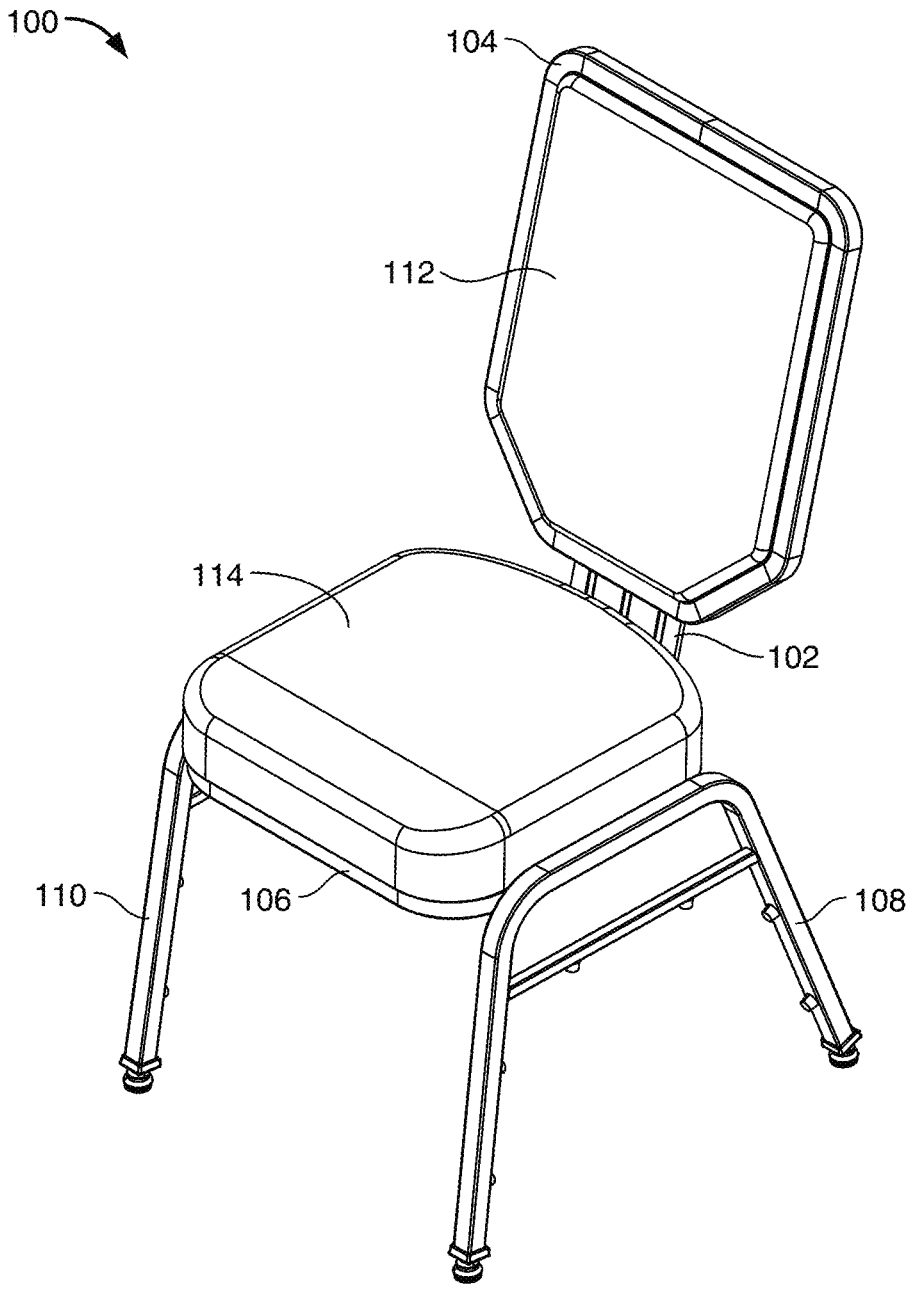
FIG. 1 shows an illustrative apparatus in accordance with principles of the disclosure.

The leftmost digit (e.g., "L") of a three-digit reference numeral (e.g., "LRR"), and the two leftmost digits (e.g., "LL") of a four-digit reference numeral (e.g., "LLRR"), generally identify the first figure in which a part is called-out.

DETAILED DESCRIPTION OF THE DISCLOSURE

A flex-back banquet chair is provided.

As used herein "mm" may refer to millimeters.

The flex-back banquet chair may include a base frame. The base frame may include a material. The material of the base may include any material as listed in Table 1.

TABLE 1

| Illustrative materials. Illustrative materials. |
|---|
| Wood |
| Plastic |
| Metal |
| Aluminum |
| 18-gauge steel |
| 16-gauge steel |
| 3-gauge steel |
| Any suitable gauge steel |
| Any other suitable materials |
| Any suitable combination thereof |

The base frame may include angular tubing, square tubing, round tubing and/or any other suitable tubing. Table 2a shows illustrative ranges that may include a diameter of the tubing. The diameter may include an inner diameter and/or an outer diameter.

TABLE 2a

| Illustrative diameter ranges. Illustrative diameter ranges. |
|---|
| 0 mm-5 mm |
| 5 mm-10 mm |
| 10 mm-15 mm |
| 15 mm-20 mm |
| 20 mm-25 mm |
| 25 mm-30 mm |
| 30 mm-35 mm |
| >35 mm |
| Other suitable diameter ranges |

Table 2b shows illustrative ranges that may include a width of the tubing. The width of the tubbing may include an inner width and/or an outer width.

TABLE 2b

| Illustrative width ranges. Illustrative width ranges. |
|---|
| 0 mm-5 mm |
| 5 mm-10 mm |
| 10 mm-15 mm |
| 15 mm-20 mm |
| 20 mm-25 mm |
| 25 mm-30 mm |
| 30 mm-35 mm |
| >35 mm |
| Other suitable width ranges |

For example, the base frame may include square tubing with a width of 22 mm.

The base frame may include a frame. The frame may have a square shape. The frame may have a square shape with rounded edges. The frame may have a rectangular shape. The frame have any other suitable quadrilateral shape. The frame may be round. The frame may have any other suitable shape.

The frame may include a first beam. The frame may include a second beam. The frame may include a third beam. The frame may include a fourth beam. The base frame may include four corner connectors. Each of the corner connectors may be rounded. Each of the corner connectors may be bent at a corner angle. Table 3 shows illustrative angle ranges that may include the corner angle.

TABLE 3

| Illustrative corner angle ranges. |
|---|
| Illustrative corner angle ranges. |
| <30° |
| 30°-60° |
| 60°-90° |
| 90°-120° |
| 120°-150° |
| 150°-179° |
| Other suitable angle ranges |

The first beam may be connected to the second beam via a first corner connector. The second beam may be connected to the third beam via a second corner connector. The third beam may be connected to the fourth beam via a third corner connector. The fourth beam may be connected to the first beam via a fourth corner connector. When the first, second, third and fourth beams are connected, the first beam may be parallel to the third beam and the second beam may be parallel to the fourth beam. The first, second, third and fourth beams may be fixedly attached, removably attached, welded and/or connected via any other suitable connection to the first, second, third and fourth corner connectors.

The base frame may include a first crossbeam. The first crossbeam may be connected to the second and fourth beams. The first crossbeam may extend in a direction that is orthogonal to the second and fourth beams. The first crossbeam may be welded to the second and fourth beams. The first crossbeam may be connected to the second and fourth beams via any other suitable connection.

The first crossbeam may define two holes. The two holes may be included in a plurality of holes.

The base frame may include a second crossbeam. The second crossbeam may be connected to the second and fourth beams. The second crossbeam may extend in a direction that is orthogonal to the second and fourth beams. The second crossbeam may be welded to the second and fourth beams. The second crossbeam may be connected to the second and fourth beams via any other suitable connection. The second crossbeam may be parallel to the first crossbeam.

The second crossbeam may define two holes. The two holes may be included in the plurality of holes.

When the second crossbeam is positioned between the rounded corners of the frame, the second crossbeam may include rounded edges in order to fit into the rounded corners of the frame. The second crossbeam may include any suitably shaped edges in order to fit into the corners of the frame.

The base frame may retain a seat assembly. The seat assembly may include a seat core. The seat core may include medium density fiberboard ("MDF"), plywood, wood, plastic, metal and/or any other suitable material. The seat assembly may include a foam section. The foam section may include foam with a density of about 1.8 pounds. The foam section may include foam with any other suitable density. The seat assembly may include a seat cover. The seat cover may include fabric, leather, vinyl, polyurethane, mesh and/ or any other suitable material. The seat cover may include single stitching, double stitching, triple stitching and/or any other suitable stitching. The seat cover may be wrapped around the foam section and the seat core. The seat cover may be stapled to a bottom of the seat core. The seat cover may be glued to the bottom of the seat core. The seat cover may be connected to the bottom of the seat core via any suitable connection.

The seat assembly may include a cushion, a wooden surface, a plastic surface, a metal surface and/or any other suitable seating surface.

The flex-back banquet chair may include a lower support assembly. The lower support assembly may include any suitable material listed in Table 1. The lower support assembly may support the base frame.

The lower support assembly may include a first side frame. The first side frame may include angular tubing, square tubing, round tubing, and/or any other suitable tubing. The tubing may include any suitable diameter as listed in Table 2a. The tubing may include any suitable width as listed in Table 2b. For example, the tubing may be square tubing with a width of 22 mm.

The first side frame may include a first leg and a second leg. The first side frame may be connected to a first side of the base frame. The first side frame may be connected to the second beam of the base frame. The first side frame may include a first leg-support crossbeam. The first leg-support crossbeam may include angular tubing, square tubing, round tubing and/or any other suitable tubing. The tubing may include any suitable diameter as listed in Table 2a. The tubing may include any suitable width as listed in Table 2b. For example, the tubing may be square tubing with a width of 13.2 mm. The first leg-support crossbeam may extend from the first leg to the second leg. The first leg-support crossbeam may be connected to the first leg and the second leg. The connections may include removable connections, fixed connections, welded connections and/or any other suitable connections.

The lower support assembly may include a second side frame. The second side frame may include angular tubing, square tubing, round tubing and/or any other suitable tubing. The tubing may include any suitable diameter as listed in Table 2a. The tubing may include any suitable width as listed in Table 2b. For example, the tubing may be square tubing with a width of 22 mm.

The second side frame may include a third leg and a fourth leg. The second side frame may be connected to a second side of the base frame. The second side of the base frame may be opposite the first side of the base frame. The second side of the base frame may be parallel to the first side of the base frame. The second side frame may be connected to the fourth beam of the base frame.

The second side frame may include a second leg-support crossbeam. The second leg-support crossbeam may include angular tubing, square tubing, round tubing and/or any other suitable tubing. The tubing may include any suitable diameter as listed in Table 2a. The tubing may include any suitable width as listed in Table 2b. For example, the tubing may be square tubing with a width of 13.2 mm. The second leg-support crossbeam may extend from the third leg to the fourth leg. The second leg-support crossbeam may be connected to the third leg and the fourth leg. The connections may include removable connections, fixed connections, welded connections and/or any other suitable connections.

The lower support assembly may include a connector. The connector may include angular tubing, square tubing, round tubing and/or any other suitable tubing. The tubing may include any suitable diameter as listed in Table 2a. The tubing may include any suitable width as listed in table 2b. For example, the tubing may be round tubing with a diameter of 13.2 mm.

The connector may connect the first side frame and the second side frame. The connector may connect the first side frame and the second side frame independent of a connection of the first side frame and the second side frame via the base frame. When the first side frame and the second side frame are connected to the base frame, the first side frame may be parallel to the second side frame. When the first side frame is parallel to the second side frame, the connector may extend in a direction that is orthogonal to the first and second side frames. One end of the connector may connect to the first side frame and another end of the connector may connect to the second side frame. The connections may include removable connections, fixed connections, welded connections and/or any other suitable connections.

The flex-back banquet chair may include a backboard frame. The backboard frame may include any suitable material listed in Table 1. The backboard frame may retain a front backrest assembly. The backboard frame may retain a back backrest assembly.

The backboard frame may include angular tubing, square tubing, round tubing and/or any other suitable tubing. The tubing may include any suitable diameter as listed in Table 2a. The tubing may include any suitable width as listed in Table 2b. For example, the tubing may be square tubing with a width of 22 mm.

The backboard frame may include a main frame. The main frame may have six sides. The main frame may be an irregular hexagon. The main frame may have any suitable number of sides. The main frame may be any suitable shape.

The backboard frame may include a plurality of support slats. The plurality of support slats may include three support slats. The plurality of support slats may include any suitable number of support slats. Each support slat may extend from a first end of the main frame to a second end of the main frame. The first end may be opposite the second end. The first end may be parallel to the second end. Each of the plurality of support slats may be configured to support the front backrest assembly and the back backrest assembly.

Each of the support slats may include any suitable material listed in Table 1. Each of the support slats may have a different shape. Each of the support slats may have a different shape depending on the shape of the backboard frame. The shape of the support slats may correspond to at least a portion of the shape of the backboard frame. Each of the support slats may be positioned in a specific location within the backboard frame. Each of the locations may fit different shaped slats. For example, if the backboard frame has a rounded top end, the support slat positioned at the rounded end may include rounded edges in order to fit into the rounded edge of the backboard frame.

Each of the support slats may have a thickness. Table 4 shows illustrative thickness ranges that may include the thickness.

TABLE 4

| Illustrative thickness ranges. |
|---|
| Illustrative thickness ranges. |
| >0.1 mm-1 mm |
| 1 mm-2 mm |
| 2 mm-3 mm |

TABLE 4-continued

| Illustrative thickness ranges. |
|---|
| Illustrative thickness ranges. |
| 3 mm-4 mm |
| 4 mm-5 mm |
| 5 mm-6 mm |
| 6 mm-7 mm |
| 7 mm-8 mm |
| 8 mm-9 mm |
| 9 mm-10 mm |
| 10 mm->10 mm |
| Other suitable thickness ranges |

Each of the support slats may have the same thickness. Each of the support slats may have different thicknesses. Each of the support slats may have any suitable combination of the same and/or different thicknesses.

Each of the support slats may be connected to the backboard frame via removable connections, fixed connections, welded connections and/or any other suitable connections.

The flex-back banquet chair may include a flex bracket. The flex bracket may be formed from sheet metal. The sheet metal may include any suitable material as listed in Table 1. The sheet metal may include a 140 mm×200 mm steel plate. The sheet metal may include any suitable sized steel plate. The steel plate may have a thickness of about 5 mm. The thickness may have any other suitable thickness.

The sheet metal may include a bend. The bend may be bent at an angle. Table 5 shows illustrative angle ranges that may include the angle.

TABLE 5

| Illustrative angle ranges. |
|---|
| Illustrative angle ranges. |
| <90° |
| 90°-95° |
| 95°-100° |
| 100°-105° |
| 105°-110° |
| >110° |
| Other suitable angle ranges |

The flex bracket may include a first mounting space. The first mounting space may extend along the flex bracket in a first direction. The first mounting space may have a smooth surface. The first mounting space may have a height. Table 6 shows illustrative height ranges that may include the height.

TABLE 6

| Illustrative height ranges. |
|---|
| Illustrative height ranges. |
| >0.1 cm-0.25 cm |
| 0.25 cm-0.50 cm |
| 0.50 cm-1.0 cm |
| 1.0 cm-1.5 cm |
| 1.5 cm-2.0 cm |
| 2.0 cm->2.0 cm |
| Other suitable height ranges |

The flex bracket may include a plurality of nerves. The plurality of nerves may include three nerves. The plurality of nerves may include any suitable number of nerves. Each of the nerves may include an indentation in the sheet metal. Each of the indentations may be concave with respect to the angle. Each of the indentations may be convex with respect to the angle, each of the indentations may be convex. Each indentation may have a depth. Table 7 shows illustrative depth ranges that may include the depth.

TABLE 7

| Illustrative depth ranges. |
|---|
| Illustrative depth ranges. |
| >0.1 mm-0.25 mm |
| 0.25 mm-0.50 mm |
| 0.50 mm-1.0 mm |
| 1.0 mm-1.5 mm |
| 1.5 mm-2.0 mm |
| 2.0 mm-2.5 mm |
| 2.5 mm-3 mm |
| 3 mm->3 mm |
| Other suitable depth ranges |

Each indentation may have a width. Table 8 shows illustrative width ranges that may include the width.

TABLE 8

| Illustrative width ranges. |
|---|
| Illustrative width ranges. |
| >0.1 mm-1 mm |
| 1 mm-2 mm |
| 2 mm-3 mm |
| 3 mm-4 mm |
| 4 mm-5 mm |
| 5 mm-6 mm |
| 6 mm-7 mm |
| 7 mm-8 mm |
| 8 mm-9 mm |
| 9 mm-10 mm |
| 10 mm->10 mm |
| Other suitable width ranges |

Each of the indentations may have the same depth. Each of the indentations may have different depths. Each of the indentations may have the same width. Each of the indentations may have different widths. Each of the indentations may have any suitable combination of the same and/or different widths and depths. Each of the indentations may have a length of about 185 mm. Each of the indentations may have any suitable length. Each of the indentations may have the same length. Each of the indentations may have different lengths. Each of the indentations may have any suitable combinations of the same and/or different lengths.

Each of the nerves may extend from a bottom edge of the first mounting space. Each of the nerves may extend in a second direction. The second direction may be a direction that is orthogonal to the first direction. Each of the nerves may extend from the bottom edge of the first mounting space until a bottom end of the sheet metal. Because each of the nerves may extend until the bottom end of the sheet metal, the bottom end of the sheet metal may not have a smooth surface. The bottom end of the sheet metal may not have a smooth surface along a length of the bottom end. A width of the bottom end may have a smooth surface.

The plurality of nerves may increase the effective thickness of the flex bracket by at least 40% (from about 5 mm to about 7 mm). Increasing the effective thickness of the flex bracket may lead to an increase in the strength of the flex bracket. The increase in strength may increase the longevity and consistency of the flexibility feature of the flex back banquet chair. The plurality of nerves may increase the strength of the flex bracket while maintaining a lighter overall weight.

The flex bracket may include a second mounting space. The second mounting space may include a part of the sheet metal that is configured to be mounted to an underside of the flex-back banquet chair. The part may be any suitable part along the sheet metal between the bend and the bottom end of the sheet metal.

The second mounting space may define four holes. Each of the four holes may correspond to one of the plurality of holes defined by the first crossbeam and the second crossbeam. Each of the four holes may align with one the plurality of holes defined by the first crossbeam and the second crossbeam.

The first mounting space may be mounted onto a back side of the backboard frame. The backboard frame may include a bottom. The first mounting space may be mounted to the back side of the bottom of the backboard frame. The second mounting space may be mounted to an underside of the base frame.

The first mounting space may be welded to the back side of the backboard frame. The first mounting space may be removably attached to the back side of the backboard frame. The first mounting space may be bolted to the back side of the backboard frame. The first mounting space may be screwed onto the back side of the backboard frame. The first mounting space may be fixedly attached to the back side of the backboard frame. The first mounting space may be mounted to the back side of the backboard frame via any suitable connection.

The first mounting space may have a smooth surface in order to enable a stronger connection of the flex bracket to the back side of the bottom of the backboard frame. The first mounting space may have a smooth surface in order to strengthen the weld between the first mounting space of the flex bracket and the back side of the bottom of the backboard frame.

The second mounting space may be mounted to the underside of the base frame. The second mounting space may be welded to the underside of the base frame. The second mounting space may be removably attached to the underside of the base frame. The second mounting space may be bolted to the underside of the base frame. The second mounting space may be screwed to the underside of the base frame. The second mounting space may be fixedly attached to the underside of the base frame. The second mounting space may be mounted to the underside of the base frame via any suitable connection.

A first screw may be screwed through a first hole defined by the second crossbeam and a corresponding first hole defined by the flex bracket. The first screw may be screwed into a first nut. A second screw may be screwed through a second hole defined by the second crossbeam and a corresponding second hole defined by the flex bracket. The second screw may be screwed into a second nut. A third screw may be screwed through a third hole defined by the first crossbeam and a corresponding third hole defined by the flex bracket. The third screw may be screwed into a third nut. A fourth screw may be screwed though a fourth hole defined by the first crossbeam and a corresponding fourth hole defined by the flex bracket. The fourth screw may be screwed into a fourth nut. Any suitable number of screws may be screwed into any suitable hole defined by the first and/or second crossbeams and a corresponding hole defined in the flex bracket.

When the first mounting space is mounted to the back side of the backboard frame and the second mounting space is mounted on the underside of the base frame, the backboard frame together with the first mounting space may recline. The backboard frame together with the first mounting space may recline in response to a force applied to the backboard frame. The backboard frame and the first mounting space may recline about a junction of the base frame and the second mounting space.

The force may be a force applied by a user. The force may be linear force, a rotational force or any other suitable force.

The bend of the sheet metal along with the plurality of nerves may enable the flex-back banquet chair to recline without separating the backboard frame from the base frame. The bend of the frame along with the plurality of nerves may revert back to a standing position after the force is no longer being applied. The standing position may be a position in which the backboard frame forms an 104° angle with respect to the base frame. The standing position may be a position in which the backboard frame forms any suitable angle (as included in Table 5) with respect to the base frame. The standing position may be a position in which the flex bracket is not extended beyond the angle of the bend. A reclined position may be a position in which the flex bracket is extended beyond the angle of the bend in response to a force by a user. Over time, as the flex bracket is continuously reclined, the angle of the standing position may increase. Over time, as the flex bracket is continuously reclined, the flexibility of the flex bracket may increase and a user may be able to recline at a greater angle.

The flex-back banquet chair may be a first flex-back banquet chair. The first flex-back banquet chair may be configured to be stacked on top of a second flex-back banquet chair. The first flex-back banquet chair may include a plurality of rubber stoppers. The rubber stoppers may enable the first flex-back banquet chair to be stacked on top of the second flex-back banquet chair. The rubber stopers may enable the first flex-back banquet chair to be removed from the second flex-back banquet chair. The rubber stoppers may lessen tension created when the first flex-back banquet chair is stacked on top of the second flex-back banquet chair. When the tension is lessened, it may be easier to remove the first flex-back banquet chair from the second flex-back banquet chair.

Apparatus and methods described herein are illustrative. Apparatus and methods in accordance with this disclosure will now be described in connection with the figures, which form a part hereof. The figures show illustrative features of apparatus and method steps in accordance with the principles of this disclosure. It is understood that other embodiments may be utilized, and that structural, functional, and procedural modifications may be made without departing from the scope and spirit of the present disclosure.

The steps of methods may be performed in an order other than the order shown and/or described herein. Embodiments may omit steps shown and/or described in connection with illustrative methods. Embodiments may include steps that are neither shown nor described in connection with illustrative methods.

Illustrative method steps may be combined. For example, an illustrative method may include steps shown in connection with another illustrative method.

Apparatus may omit features shown and/or described in connection with illustrative apparatus. Embodiments may include features that are neither shown nor described in connection with the illustrative apparatus. Features of illustrative apparatus may be combined. For example, an illustrative embodiment may include features shown in connection with another illustrative embodiment.

The drawings show illustrative features of apparatus and methods in accordance with the principles of the invention. The features are illustrated in the context of selected embodiments. It will be understood that features shown in connection with one of the embodiments may be practiced in accordance with the principles of the invention along with features shown in connection with another of the embodiments.

FIG. 1 shows illustrative flex-back banquet chair 100. Flex-back banquet chair 100 may include base frame 106. Base frame 106 may retain seating assembly 114. Flex-back banquet chair 100 may include backboard frame 104. Backboard frame 104 may retain front backrest assembly 112. Base frame 106 may be connected to backboard frame 104 via flex bracket 102. Flex bracket 102 may be mounted to base frame 106. Flex bracket 102 may be welded to backboard frame 104.

Flex-back banquet chair 100 may include side frame 108. Flex-back banquet chair 100 may include side frame 110. Side frame 108 may include a first leg and a second leg. Side frame 110 may include a third leg and a fourth leg. Side frame 108 and side frame 110 may be connected to base frame 106. Side frame 108 may be welded to base frame 106. Side frame 110 may be welded to base frame 106.

Figure 2:
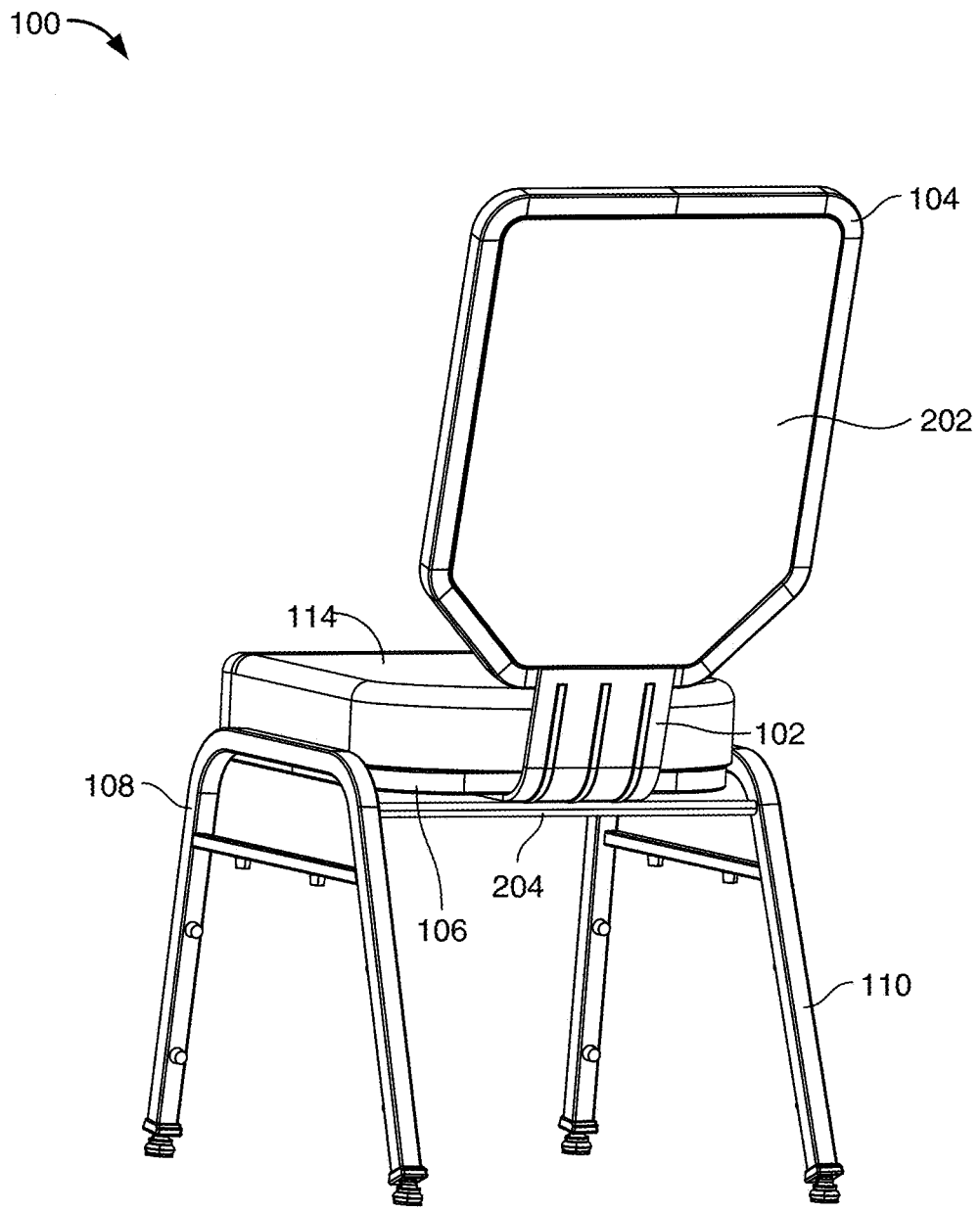
FIG. 2 shows another illustrative apparatus in accordance with principles of the disclosure.

FIG. 2 shows a back view of flex-back banquet chair 100.

Backboard frame 104 may retain back backrest assembly 202.

Flex-back banquet chair 100 may include connector 204. When side frame 108 and side frame 110 are connected to base frame 106, side frame 108 may be parallel to side frame 110. Connector 204 may extend from side frame 108 to side frame 110. One side of connector 204 may be welded to side frame 108. The other side of connector 204 may be welded to side frame 110.

Connector 204 may connect side frame 108 to side frame 110 independent of a connection of side frame 108 to side frame 110 via base frame 106.

Figure 3:
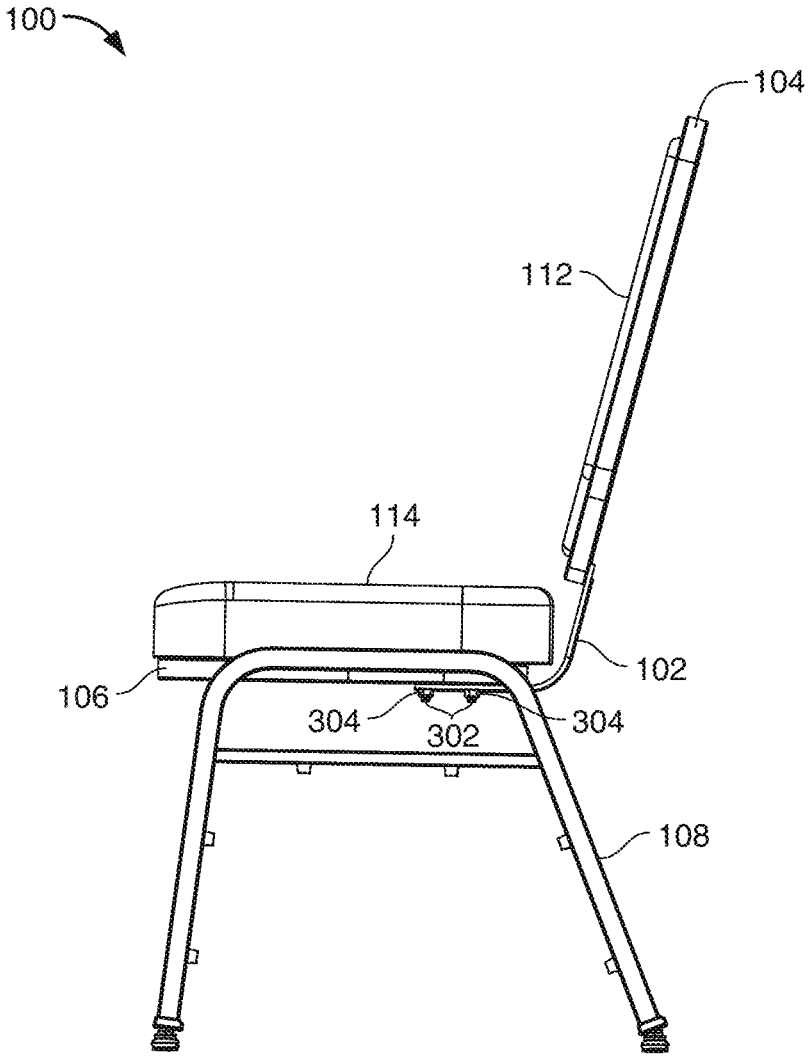
FIG. 3 shows yet another illustrative apparatus in accordance with principles of the disclosure.

FIG. 3 shows a side view of flex-back banquet chair 100.

Flex bracket 102 may be mounted to base frame 106 via screws 302. Screws 302 may be screwed into nuts 304.

Figure 4:
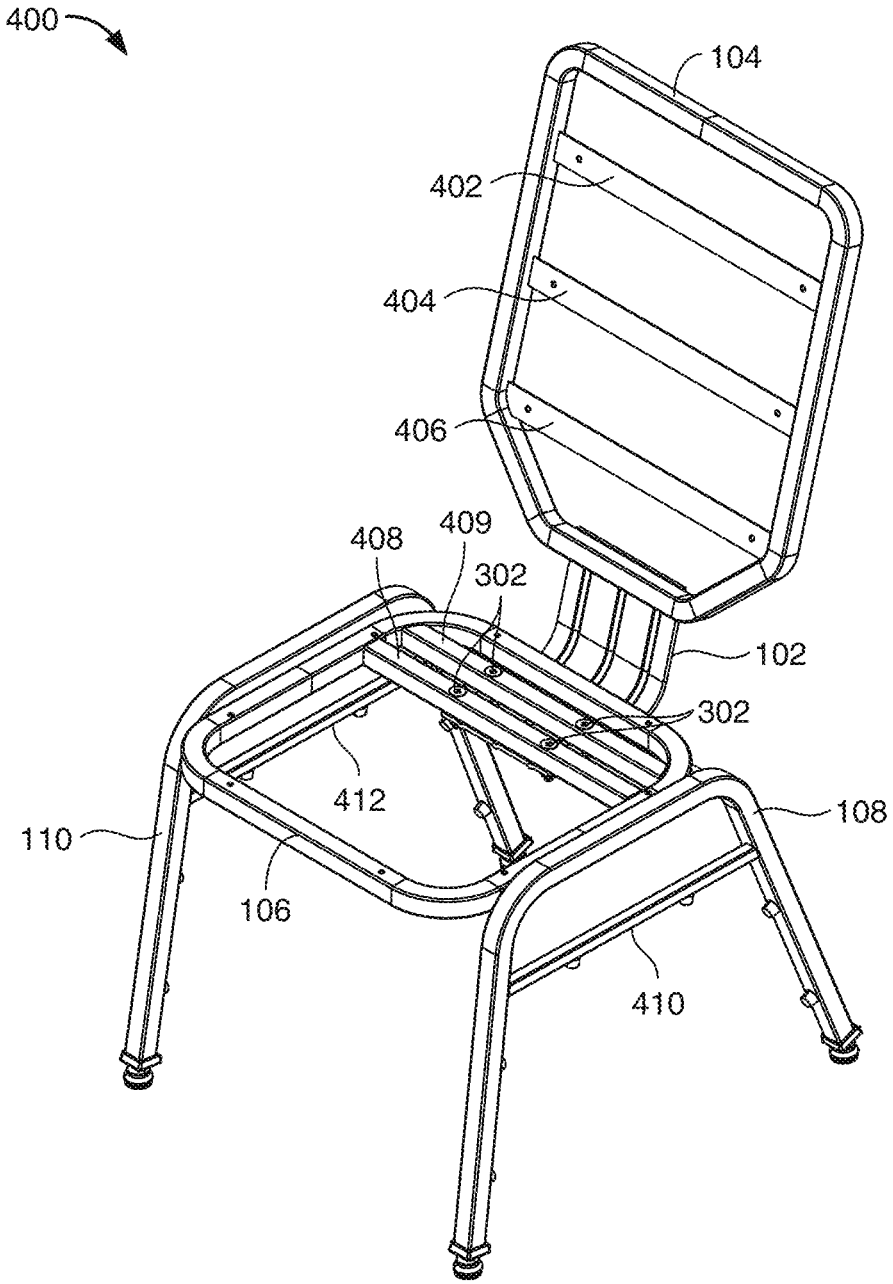
FIG. 4 shows still another illustrative apparatus in accordance with principles of the disclosure.

FIG. 4 shows illustrative frame 400 of flex-back banquet chair 100. Base frame 106 may include a frame. The frame may include crossbeam 408. One side of crossbeam 408 may be welded to a first side of the frame. The other side of crossbeam 408 may be welded to a second side of the frame. The first side of the frame may be parallel to the second side of the frame. Crossbeam 408 may extend in a direction that is orthogonal to the first and second sides of the frame.

The frame may include crossbeam 409. One side of crossbeam 409 may be welded to a first side of the frame. The other side of crossbeam 409 may be welded to a second side of the frame. The first side of the frame may be parallel to the second side of the frame. Crossbeam 409 may extend in a direction that is orthogonal to the first and second sides of the frame. Crossbeam 409 may be parallel to crossbeam 408.

Screws 302 may be screwed in from a top side of base frame 106. Screws 302 may be screwed through crossbeam 408, crossbeam 409 and flex bracket 102.

Backboard frame 104 may include support slats 402, 404 and 406. One side of each of support slats 402, 404 and 406 may be welded to a first side of backboard frame 104. The other side of each of support slats 402, 404 and 406 may be welded to a second side of backboard frame 104. The first side of backboard frame 104 may be parallel to the second side of backboard frame 104. Support slats 402, 404 and 406 may extend in a direction that is orthogonal to the first and second sides of backboard frame 104. Support slats 402, 404 and 406 may support front backrest assembly 112 (shown in FIG. 1) and back backrest assembly 202 (shown in FIG. 2).

Side frame 108 may include first leg-support crossbeam 410. First leg-support crossbeam 410 may be welded to the first leg included in side frame 108. First leg-support crossbeam 410 may be welded to the second leg included in side frame 108. Side frame 110 may include second leg-support crossbeam 412. Second leg-support crossbeam 412 may be welded to the third leg included in side frame 110. Second leg-support crossbeam 412 may be welded to the fourth leg included in side frame 110.

Figure 5:
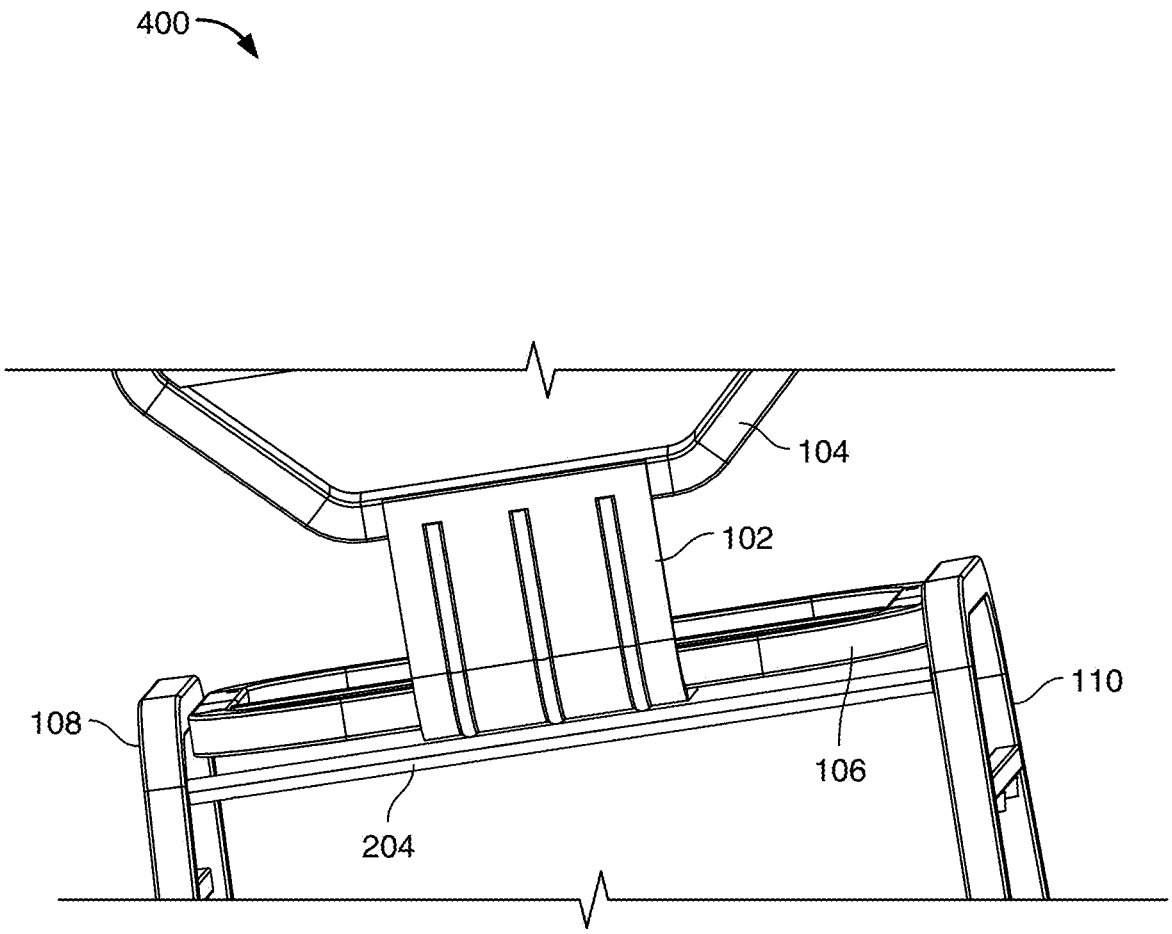
FIG. 5 shows a portion of an illustrative apparatus in accordance with principles of the disclosure.

FIG. 5 shows a partial back view of frame 400. Flex bracket 102 may be welded to a bottom end of backboard frame 104. Flex bracket 102 may be welded to a back of the bottom end of backboard frame 104. Flex bracket 102 may be mounted to an underside of base frame 106.

Figure 6:
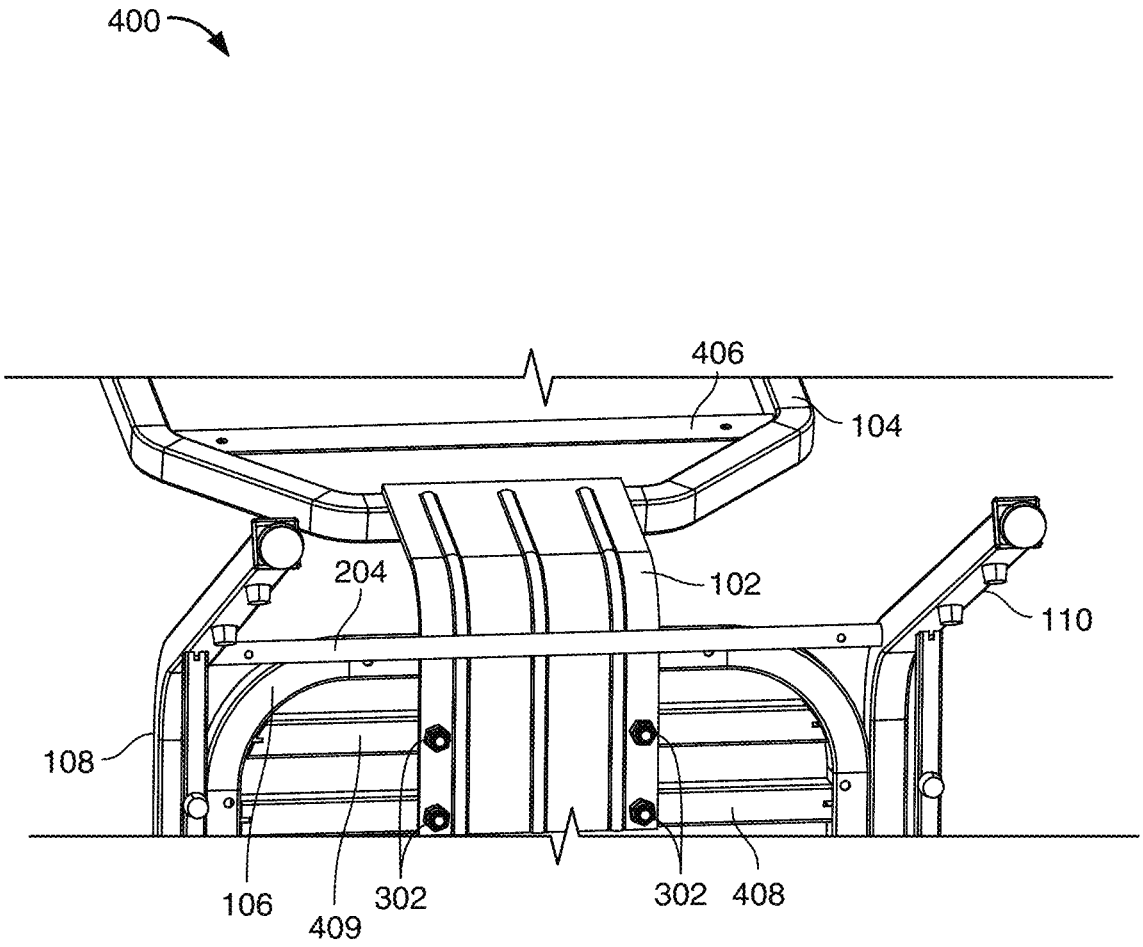
FIG. 6 shows another portion of an illustrative apparatus in accordance with principles of the disclosure.

FIG. 6 shows a partial bottom view of frame 400. Flex bracket 102 may be mounted to an underside of the frame included in base frame 106. Flex bracket 102 may be mounted to an underside of crossbeam 408. Flex bracket 102 may be mounted to an underside of crossbeam 409. Flex bracket 102 may not be connected, screwed and/or welded to connector 204.

Figure 7:
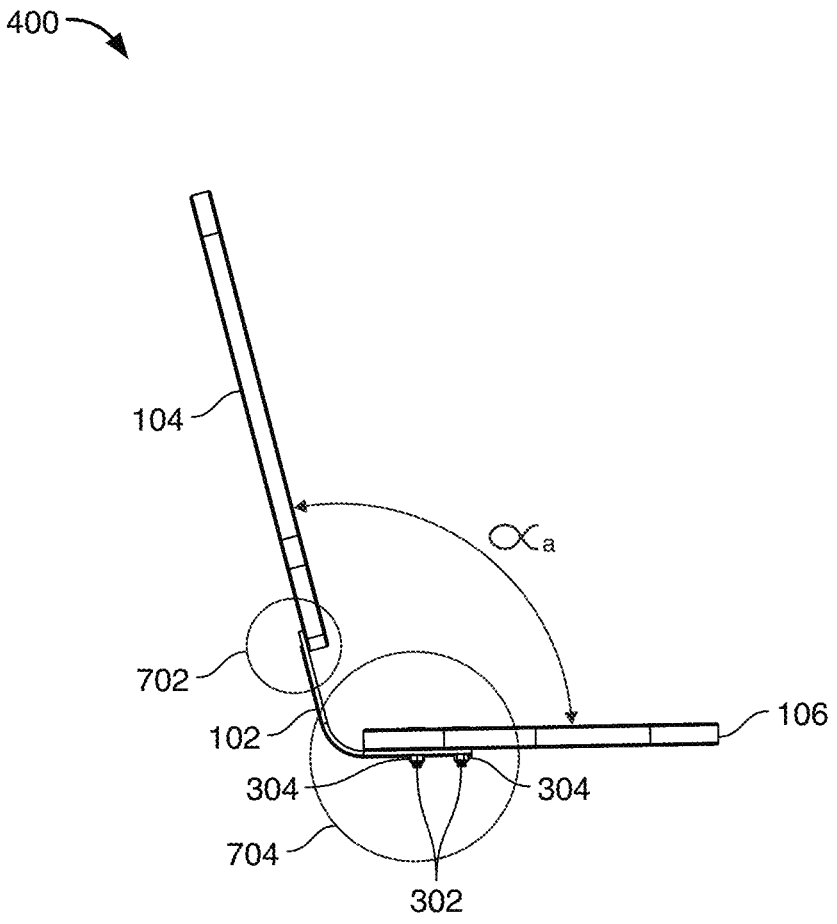
FIG. 7 shows an illustrative apparatus in accordance with principles of the disclosure.

FIG. 7 shows a partial side view of frame 400. Flex bracket 102 may be welded to backboard frame 104. Flex bracket 102 may be welded to backboard frame 104 at weld 702. Flex bracket 102 may be mounted to base frame 106. Flex bracket 102 may be mounted to base frame 106 at attachment 704. Flex bracket 102 may be bent at angle $\alpha_a$. Table 9 shows illustrative angle ranges that may include angle $\alpha_a$.

TABLE 9

| Illustrative angle ranges. |
|---|
| Illustrative angle ranges. |
| <90° |
| 90°-95° |
| 95°-100° |
| 100°-105° |
| 105°-110° |
| >110° |
| Other suitable angle ranges |

When backboard frame 104 and base frame 106 are connected to flex bracket 102, backboard frame 104 may be tilted at an aa angle, with respect to base frame 106.

Figure 8:
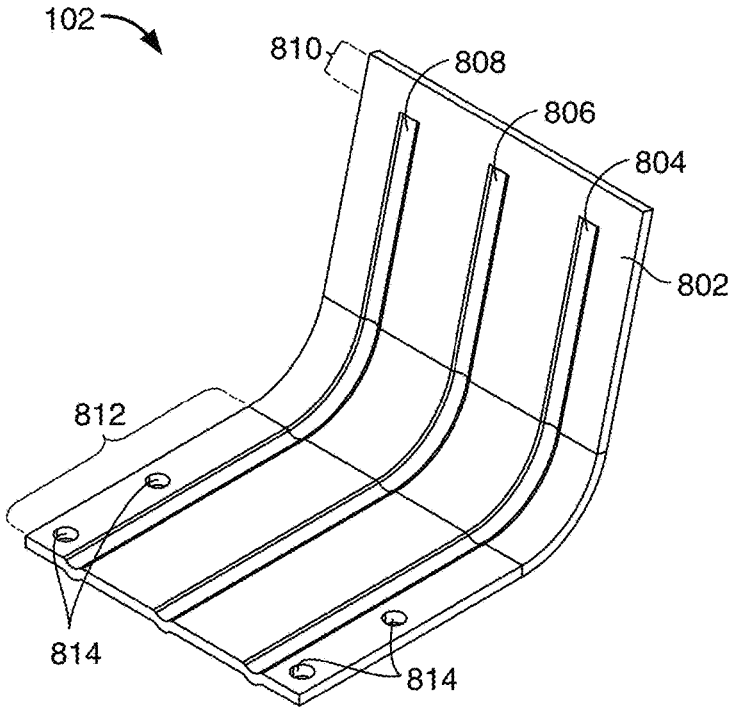
FIG. 8 shows another illustrative apparatus in accordance with principles of the disclosure.

FIG. 8 shows an illustrative view of flex bracket 102. Flex bracket 102 may include front face 802. Flex bracket may include nerves 804, 806 and 808. Nerves 804, 806 and 808 may include indentations that are concave with respect to front face 802.

Flex bracket 102 may include first mounting space 810. First mounting space 810 may extend along a top end of flex bracket 102. Nerves 804, 806 and 808 may extend from a bottom edge of first mounting space 810 until a bottom end of flex bracket 102. Flex bracket 102 may include second mounting space 812.

First mounting space 810 may include a smooth surface. First mounting space 810 may be welded to the back end of backboard frame 104. Second mounting space 812 may not include a smooth surface. Second mounting space 812 may include indentations defined by nerves 804, 806 and 808. Second mounting space 812 may define holes 814. Holes 814 may be configured to receive screws 302 (shown in FIG. 3). Second mounting space 812 may be mounted to the underside of base frame 106.

Figure 9:
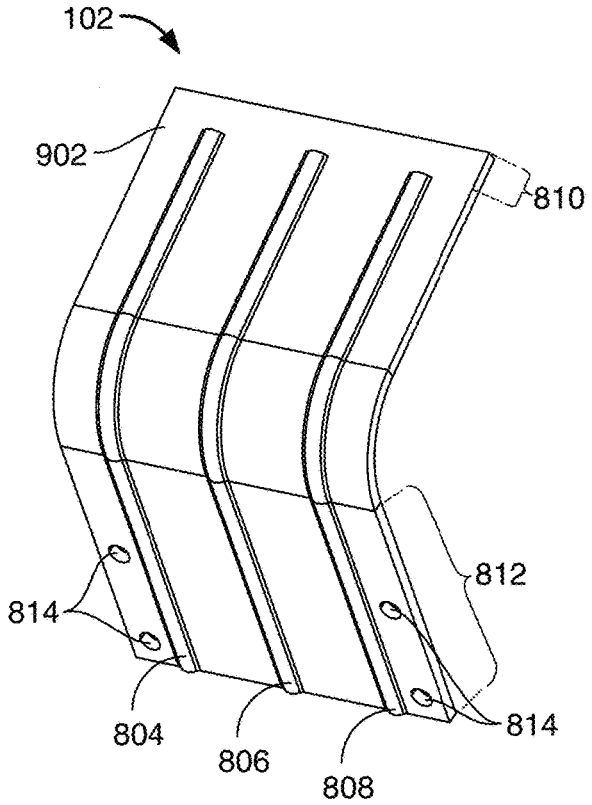
FIG. 9 shows still another illustrative apparatus in accordance with principles of the disclosure.

FIG. 9 shows a back view of flex bracket 102. Flex bracket 102 may include back face 902. The indentations included in nerves 804, 806 and 808 may be convex with respect to back face 902.

Figure 10:
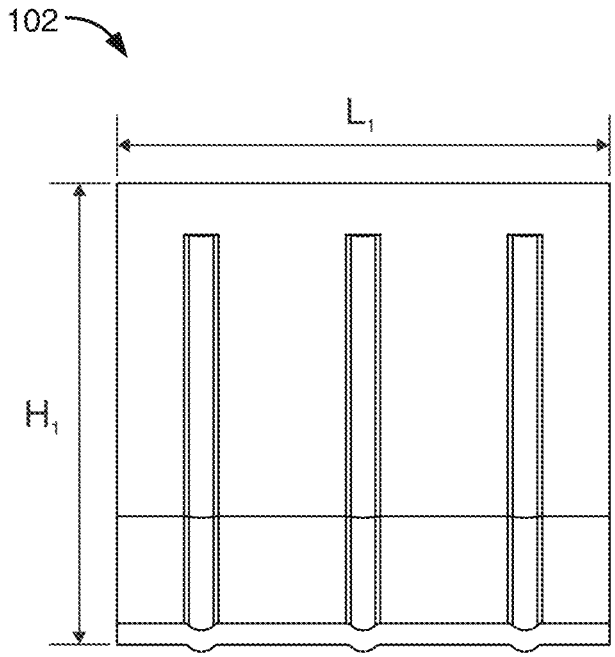
FIG. 10 shows yet another illustrative apparatus in accordance with principles of the disclosure.

FIG. 10 shows an illustrative view of flex bracket 102.

Figure 11:
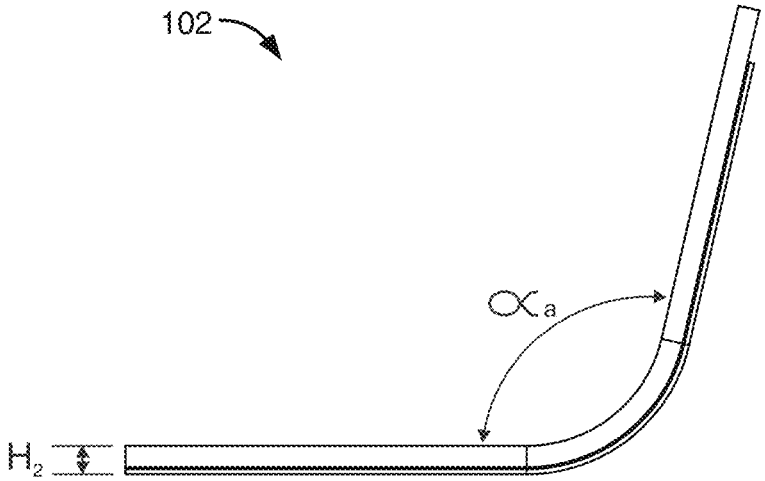
FIG. 11 shows still another illustrative apparatus in accordance with principles of the disclosure.

FIG. 11 shows a side view of flex bracket 102.

Flex bracket 102 may include dimensions. Table 10 lists the dimensions and corresponding ranges.

TABLE 10

Illustrative dimensions and corresponding ranges of flex bracket 102.

| Illustrative dimensions | | | |
|---|---|---|---|
| Dimension | Lower limit (mm) | Upper limit (mm) | Example (mm) |
| $L_1$ | <20 | >250 | 140.0 |
| $H_1$ | <20 | >250 | 131.2 |
| $H_2$ | <.01 | >20 | 8.1 |
| Other suitable dimension | Other suitable ranges | | Other suitable examples |

Figure 12:
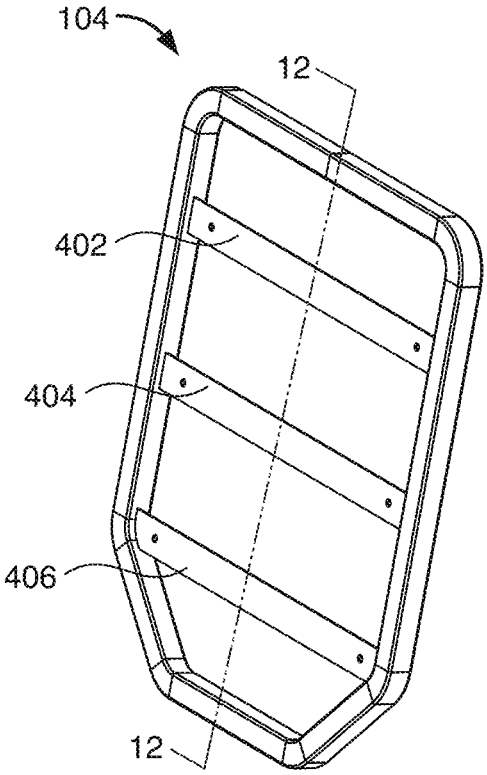
FIG. 12 shows yet another illustrative apparatus in accordance with principles of the disclosure.

FIG. 12 shows an illustrative view of backboard frame 104.

Figure 13:
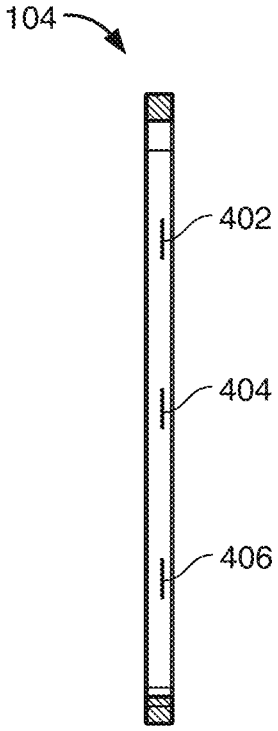
FIG. 13 shows still another illustrative apparatus in accordance with principles of the disclosure.

FIG. 13 shows a cross-sectional view of backboard frame 104 taken along view lines 12-12.

Figure 14:
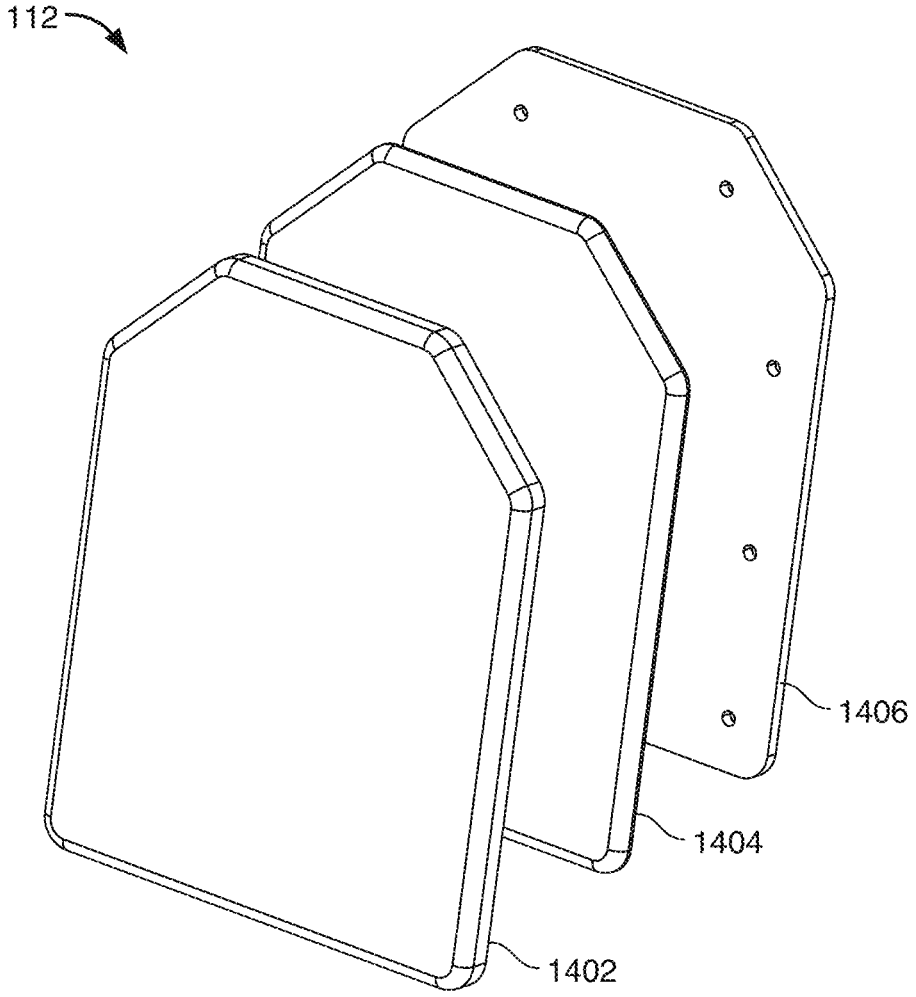
FIG. 14 shows illustrative apparatuses in accordance with principles of the disclosure.

FIG. 14 shows an illustrative view of front backrest assembly 112. Front backrest assembly 112 may be retained by backboard frame 104. Front backrest assembly 112 may include core 1406. Core 1406 may include medium-density fiberboard ("MDF"). Core 1406 may include any other suitable material. Tee nuts (not shown) may be positioned in core 1406. The tee nuts may be configured to receive plastic rivets (not shown) included in back backrest assembly 202. Front backrest assembly 112 may include foam 1404. Foam 1404 may include 12 mm thick foam. Foam 1404 may include any other suitable foam. Front backrest assembly 112 may include fabric 1402. Fabric 1402 may include upholstery, leather, vinyl and/or any other suitable fabric. Fabric 1402 may be wrapped around foam 1404 and core 1406. Fabric 1402 may be attached to a back surface of core 1406. Fabric 1402 may be attached to a back surface of core 1406 via glue, staples, stitching, screws and/or any other suitable connector. Fabric 1402 may completely cover the back surface of core 1406.

Figure 15:
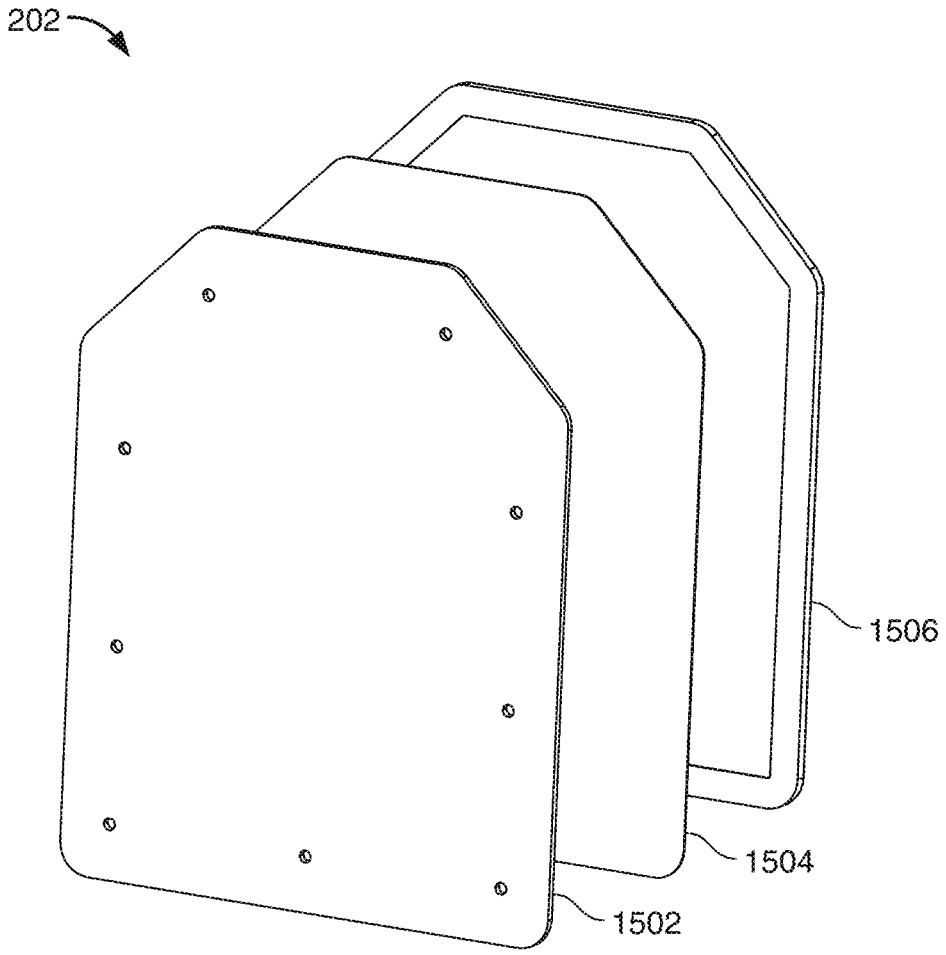
FIG. 15 shows illustrative apparatuses in accordance with principles of the disclosure.

FIG. 15 shows an illustrative view of back backrest assembly 202. Back backrest assembly 202 may be retained by backboard frame 104. Back backrest assembly 202 may include core 1502. Core 1502 may include MDF. Core 1502 may include any other suitable material. Plastic rivets (not shown) may be positioned through core 1502. The plastic rivets may be configured to be pressed fit into the tee nuts (not shown) included in front backrest assembly 112.

Back backrest assembly 202 may include foam 1504. Foam 1504 may include 12 mm thick foam. Foam 1504 may include any other suitable foam. Back backrest assembly 202 may include fabric 1506. Fabric 1506 may include upholstery, leather, vinyl and/or any other suitable fabric.

Fabric 1506 may be wrapped around foam 1504 and core 1502 Fabric 1506 may be attached to a back surface of core 1502. Fabric 1506 may be attached to a back surface of core 1502 via glue, staples, stitching, screws and/or any other suitable connector. Fabric 1506 may completely cover the back surface of core 1502.

Front backrest assembly 112 may be positioned on a first side of support slats 402, 404 and 406. Back backrest assembly 202 may be positioned on a second side of support slats 402, 404 and 406. When front backrest assembly 112 and back backrest assembly 202 are connected via the plastic rivets and tee nuts (not shown), support slats 402, 404 and 406 may be in between front backrest assembly 112 and back backrest assembly 202.

Figure 16:
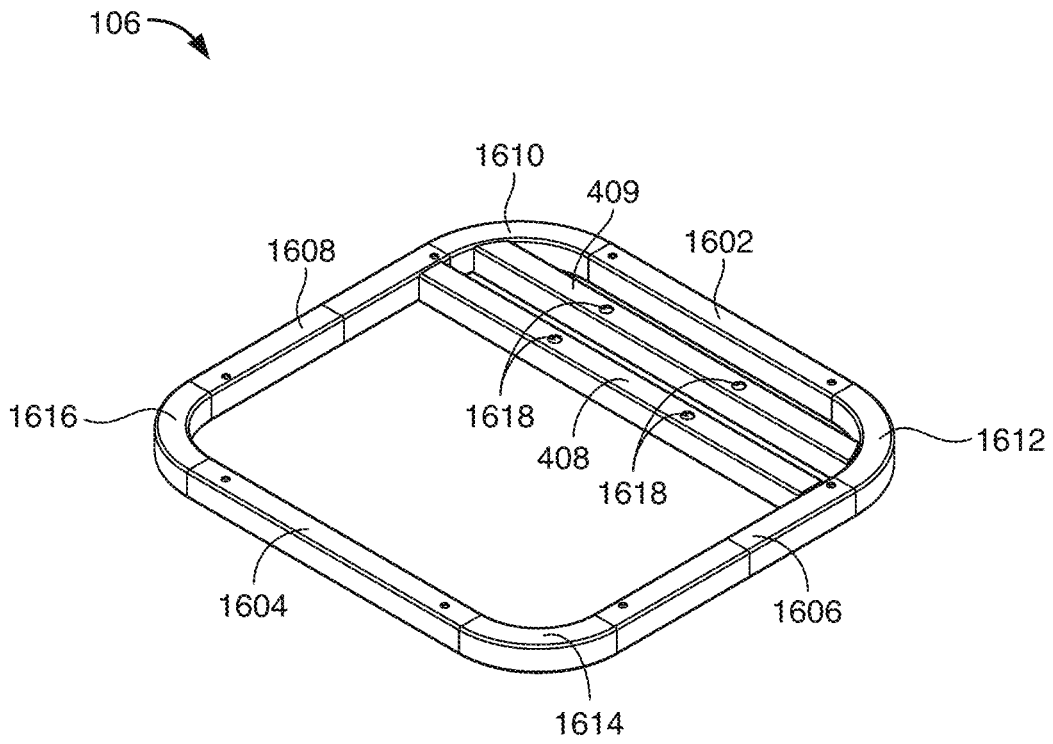
FIG. 16 shows another illustrative apparatus in accordance with principles of the disclosure.

FIG. 16 shows an illustrative view of base frame 106. Base frame 106 may include a frame. The frame may include first side 1604. The frame may include second side 1606. The frame may include third side 1602. The frame may include fourth side 1608. First side 1604 may be parallel to third side 1602. Second side 1606 may be parallel to fourth side 1608.

First side 1604 may be connected to second side 1606 via connector 1614. Second side 1606 may be connected to third side 1602 via connector 1612. Third side 1602 may be connected to fourth side 1608 via connector 1610. Fourth side 1608 may be connected to first side 1604 via connector 1616.

Crossbeam 408 may extend from second side 1606 to fourth side 1608. Crossbeam 408 may be welded to second side 1606 and fourth side 1608.

Crossbeam 409 may extend from second side 1606 to fourth side 1608. Crossbeam 409 may be welded to second side 1606 and fourth side 1608.

Crossbeam 408 and crossbeam 409 may define holes 1618. Holes 1618 may correspond to holes 814 (shown in FIG. 8). Holes 1618 may be configured to receive screws 302 (shown in FIG. 3).

Figure 17:
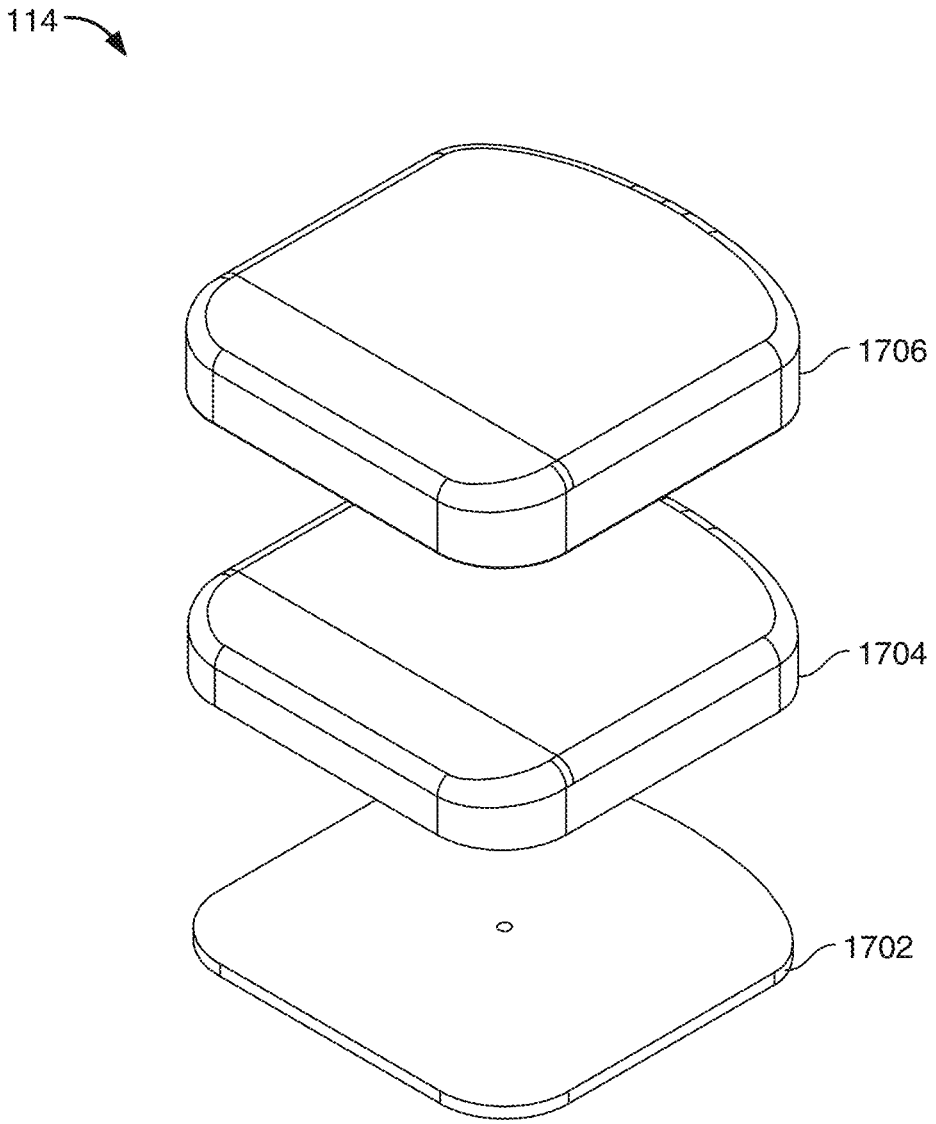
FIG. 17 shows illustrative apparatuses in accordance with principles of the disclosure.

FIG. 17 shows an illustrative view of seat assembly 114. Seat assembly 114 may be retained by base frame 106. Seat assembly 114 may include core 1702. Core 1702 may include MDF. Core 1702 may include any other suitable material.

Seat assembly 114 may include foam 1704. Foam 1704 may include 2.5-inch-thick foam. Foam 1704 may include any other suitable foam. Seat assembly 114 may include fabric 1706. Fabric 1706 may include upholstery, leather, vinyl and/or any other suitable fabric.

Fabric 1706 may be wrapped around foam 1704 and core 1702. Fabric 1706 may be attached to a back surface of core 1702. Fabric 1706 may be attached to a back surface of core 1702 via glue, staples, stitching, screws and/or any other suitable connector. Fabric 1706 may completely cover the back surface of core 1702.

Figure 18:
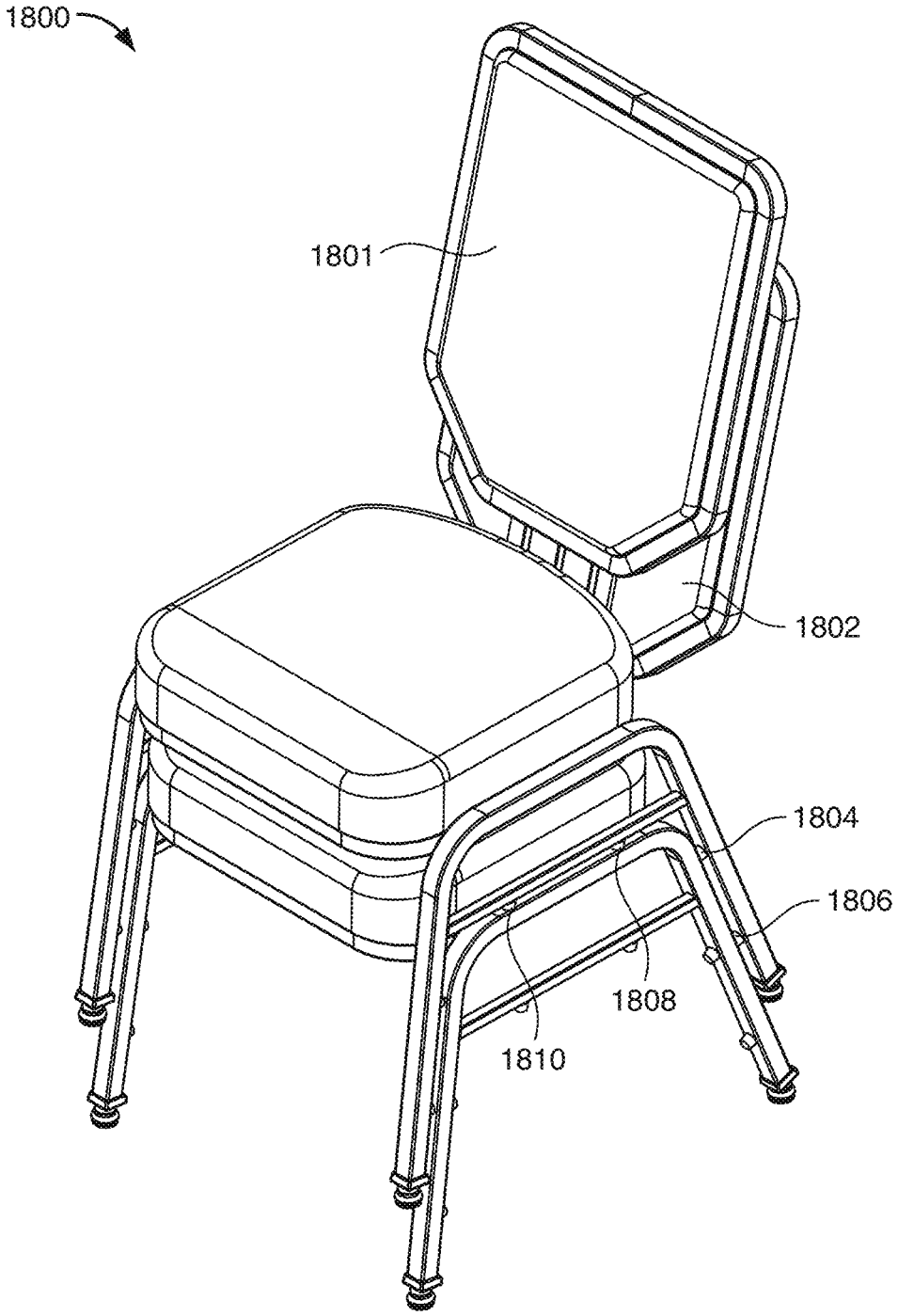
FIG. 18 shows illustrative apparatuses in accordance with principles of the disclosure.

FIG. 18 shows an illustrative view of stacked flex-back banquet chairs 1800.

Flex-back banquet chair 1801 may be stacked on top of flex-back banquet chair 1802. Flex-back banquet chairs 1801 and 1802 may have one or more features in common with flex-back banquet chair 100. Flex-back banquet chair 1801 may include stoppers, such as 1804, 1806, 1808 and 1810. Stoppers 1804, 1806, 1808 and 1810 may enable flex-back banquet chair 1801 to stack on top of flex-back banquet chair 1802. Stoppers 1804, 1806, 1808 and 1810 may decrease tension between flex-back banquet chair 1801 and flex-back banquet chair 1802, enabling flex-back banquet chair 1801 to be easily removed from on top of flex-back banquet chair 1802.

Figure 19A:
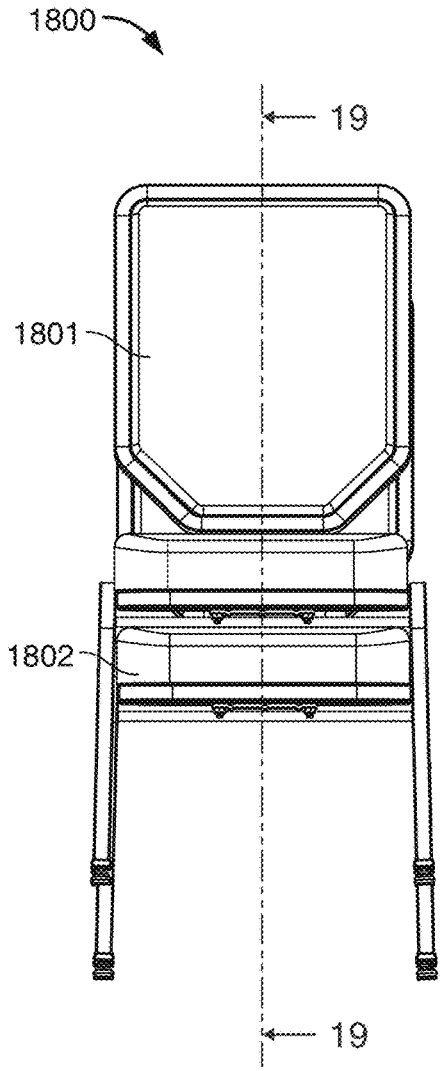
FIGS. 19A-19B show illustrative apparatuses in accordance with principles of the disclosure.

FIG. 19A shows a front view of stacked flex-back banquet chairs 1800.

Figure 19B:
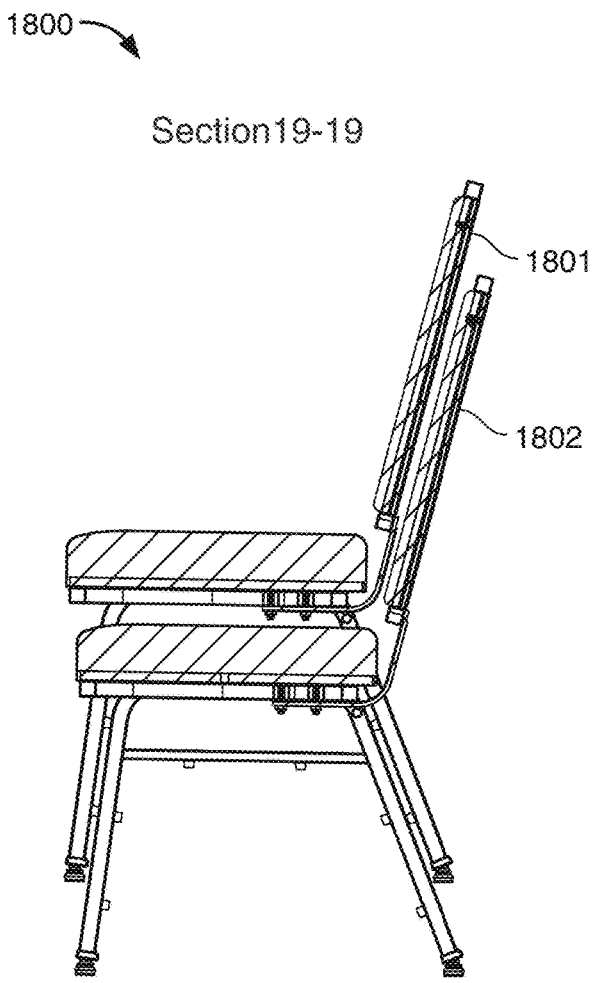

FIG. 19B shows a cross-sectional view of stacked flex-back banquet chairs 1800 taken along view line 19-19.

Figure 20B:
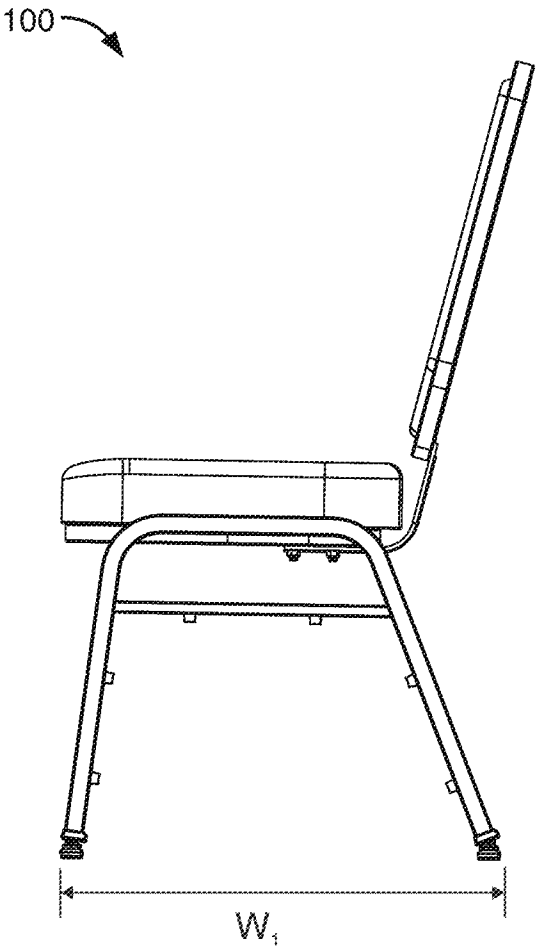
FIGS. 20A-20B show illustrative apparatuses in accordance with principles of the disclosure.
Figure 20A:
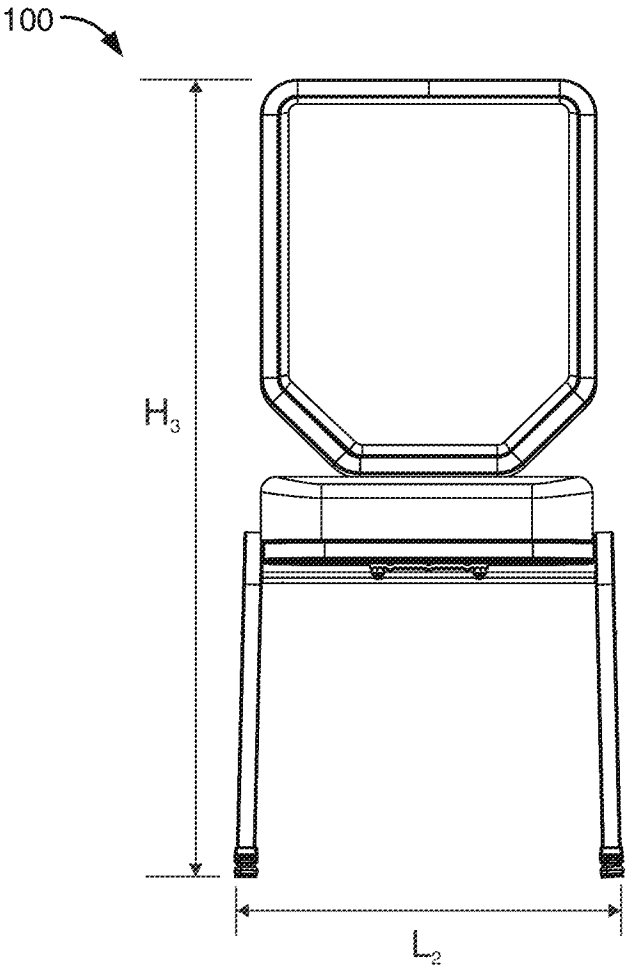

FIGS. 20A-20B show illustrative views of flex-back banquet chair 100. Flex-back banquet chair 100 may include dimensions. Table 11 lists the dimensions and corresponding ranges.

TABLE 11

Illustrative dimensions and corresponding ranges of flex-back banquet chair 100.

| Illustrative dimensions | | | |
|---|---|---|---|
| Dimension | Lower limit (mm) | Upper limit (mm) | Example (mm) |
| $H_3$ | <150 | >1050 | 947.0 |
| $L_2$ | <75 | >550 | 458 |
| $W_2$ | <100 | >650 | 558 |
| Other suitable dimension | Other suitable ranges | | Other suitable examples |

Figure 21A:
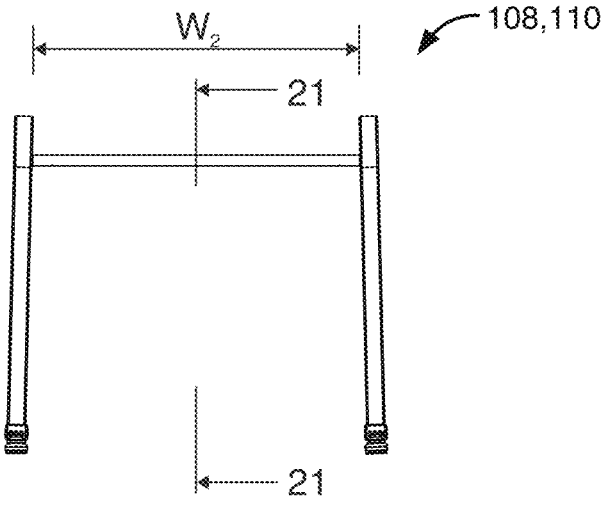
FIGS. 21A-21C show illustrative apparatuses in accordance with principles of the disclosure.
Figure 21B:
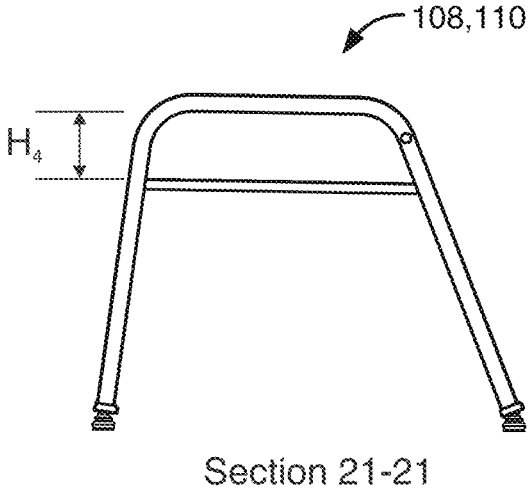
Figure 21C:
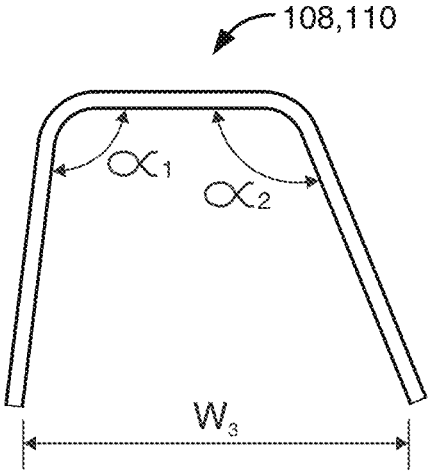

FIGS. 21A-21C show illustrative views of side frame 108/110. Side frame 108 may mirror side frame 110. Side frame 108/110 may include dimensions. Table 12 lists the dimensions and corresponding ranges.

TABLE 12

Illustrative dimensions and corresponding ranges of side frame 108/110.

| Illustrative dimensions | | | |
|---|---|---|---|
| Dimension | Lower limit (mm) | Upper limit (mm) | Example (mm) |
| $W_2$ | <50 | >500 | 395.0 |
| $H_4$ | <5 | >200 | 81.5 |
| $W_3$ | <75 | >600 | 470.7 |
| $\alpha_1$ | 0° | >100° | 97° |
| $\alpha_2$ | 0° | >115° | 112° |
| Other suitable dimension | Other suitable ranges | | Other suitable examples |

Figure 22A:
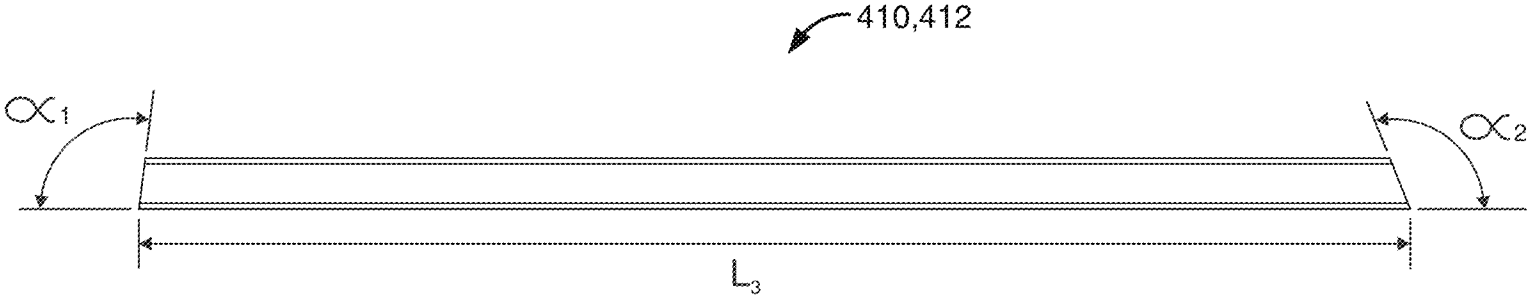
FIGS. 22A-22B show illustrative apparatuses in accordance with principles of the disclosure.
Figure 22B:
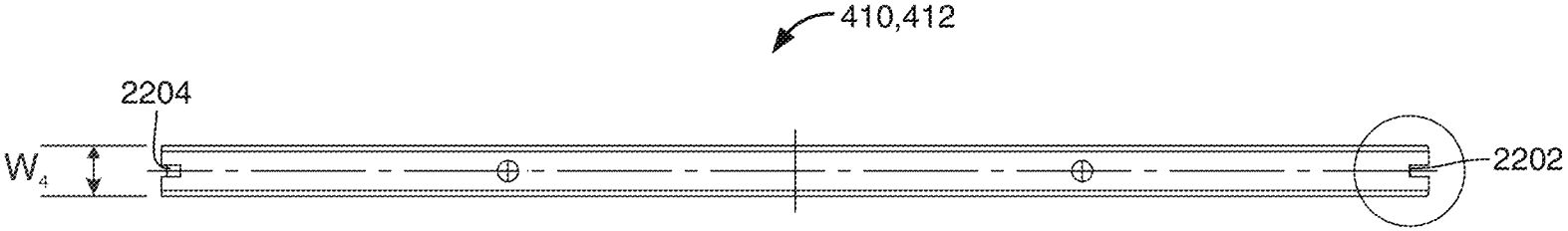

FIGS. 22A-22B show illustrative views of first leg-support crossbeam 410/second leg-support crossbeam 412. First leg-support crossbeam 410/second leg-support crossbeam 412 may include dimensions. Table 13 lists the dimensions and corresponding ranges.

TABLE 13

Illustrative dimensions and corresponding ranges of leg-support crossbeam 410/412.

| Illustrative dimensions | | | |
|---|---|---|---|
| Dimension | Lower limit (mm) | Upper limit (mm) | Example (mm) |
| $L_3$ | <50 | >500 | 330.0 |
| $W_5$ | <5 | >50 | 13.2 |
| $\alpha_1$ | 0° | >100° | 97° |
| $\alpha_2$ | 0° | >115° | 112° |
| Other suitable dimension | Other suitable ranges | | Other suitable examples |

First leg-support crossbeam 410 and second leg-support crossbeam 412 may each include cutouts 2202 and 2204. Edges of first leg-support crossbeam 410 and second leg-support crossbeam 412 may be rounded at an angle to fit into side frame 108 and side frame 110.

Figure 23:
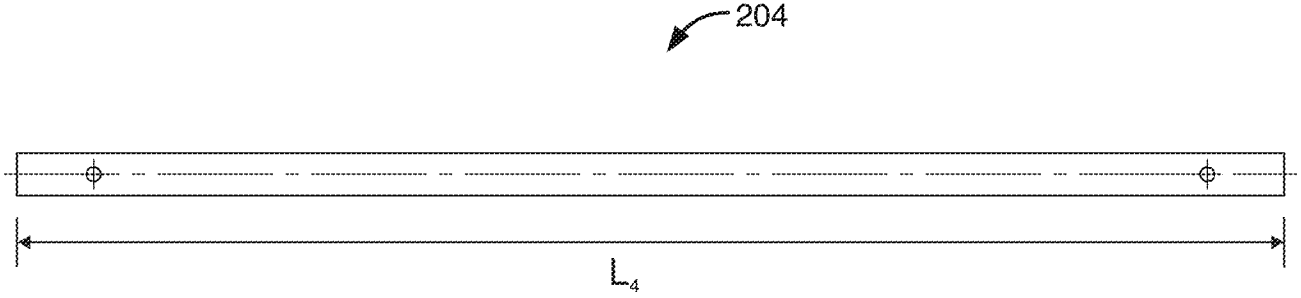
FIG. 23 shows another illustrative apparatus in accordance with principles of the disclosure.
Figure 24B:
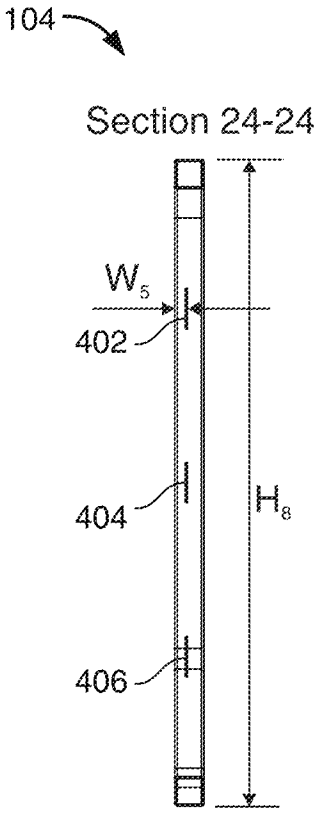
FIGS. 24A-24D show illustrative apparatuses in accordance with principles of the disclosure.
Figure 24A:
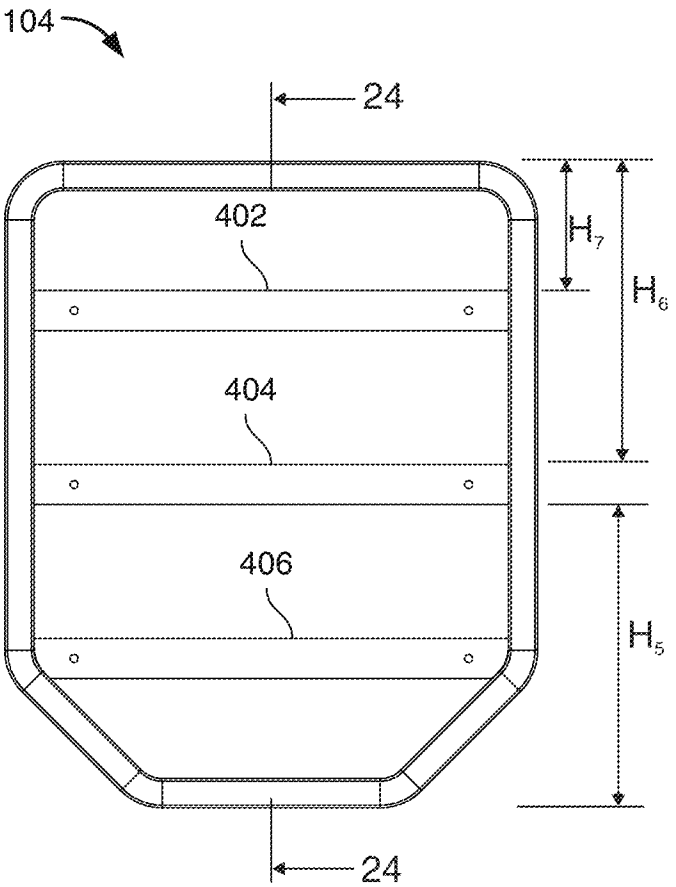
Figure 24D:
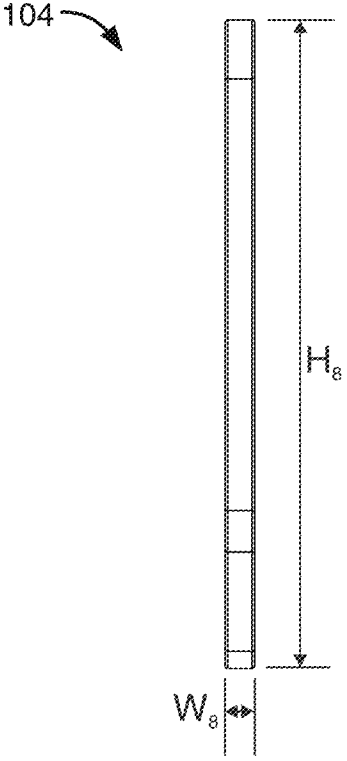
Figure 24C:
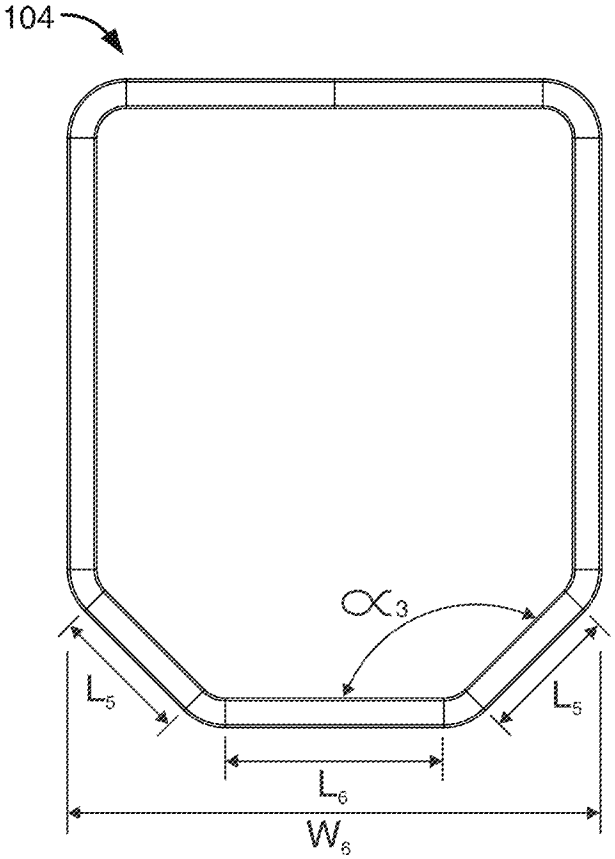

FIG. 23 shows an illustrative view of connector 204. Connector 204 may include dimensions. Table 14 lists the dimensions and corresponding ranges.

TABLE 14

Illustrative dimensions and corresponding ranges of connector 204.

| Illustrative dimensions | | | |
|---|---|---|---|
| Dimension | Lower limit (mm) | Upper limit (mm) | Example (mm) |
| $L_4$ | <50 | >500 | 396.0 |
| Other suitable dimension | Other suitable ranges | | Other suitable examples |

FIGS. 24A-24D show illustrative views of backboard frame 104. Backboard frame 104 may include dimensions. Table 15 lists the dimensions and corresponding ranges.

TABLE 15

Illustrative dimensions and corresponding ranges of backboard frame 104.

| Illustrative dimensions | | | |
|---|---|---|---|
| Dimension | Lower limit (mm) | Upper limit (mm) | Example (mm) |
| $H_5$ | <50 | >400 | 227.5 |
| $H_6$ | <50 | >400 | 227.5 |
| $H_7$ | <5 | >200 | 97.0 |
| $H_8$ | <50 | >600° | 485.0 |
| $W_5$ | <.5 | >20 | 8.0 |
| $W_6$ | <50 | >600 | 400.0 |
| $W_7$ | <5 | >50 | 22.0 |
| $L_5$ | <5 | >200 | 105.0 |
| $L_6$ | <5 | >250 | 163.5 |
| $\alpha_3$ | 0° | >180° | 135° |
| Other suitable dimension | Other suitable ranges | | Other suitable examples |

Figure 25A:
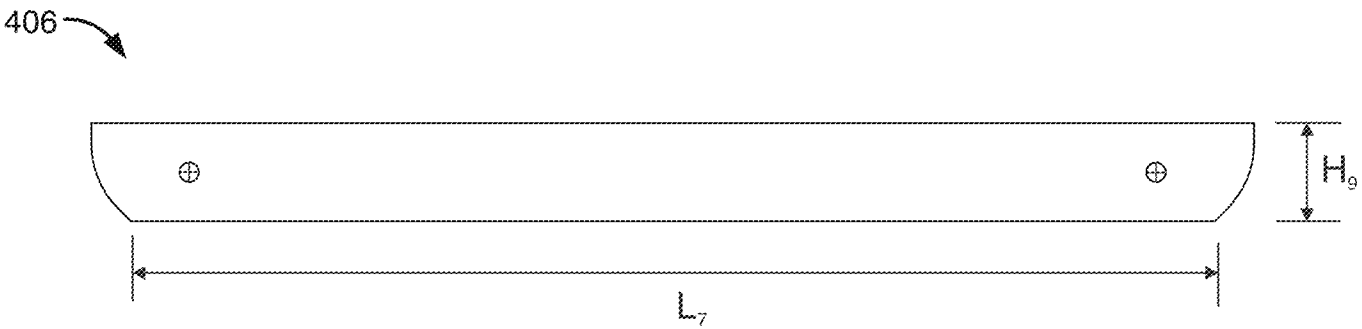
FIGS. 25A-25B show illustrative apparatuses in accordance with principles of the disclosure.
Figure 25B:
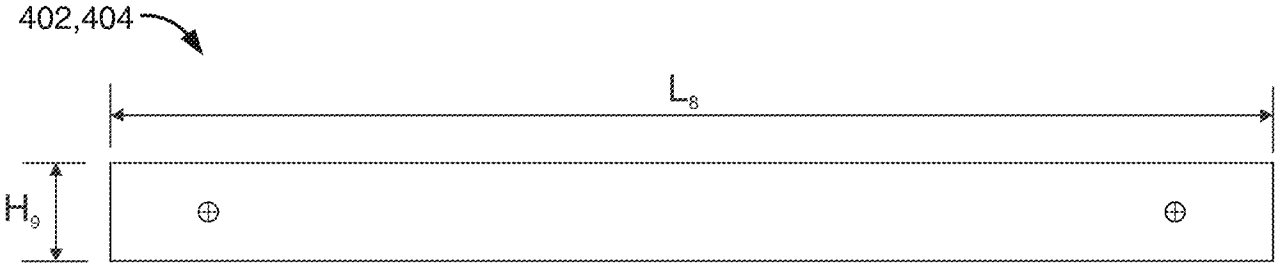
Figure 26B:
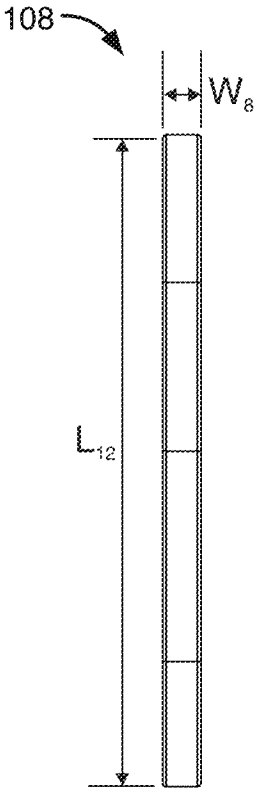
FIGS. 26A-26D show illustrative apparatuses in accordance with principles of the disclosure.
Figure 26A:
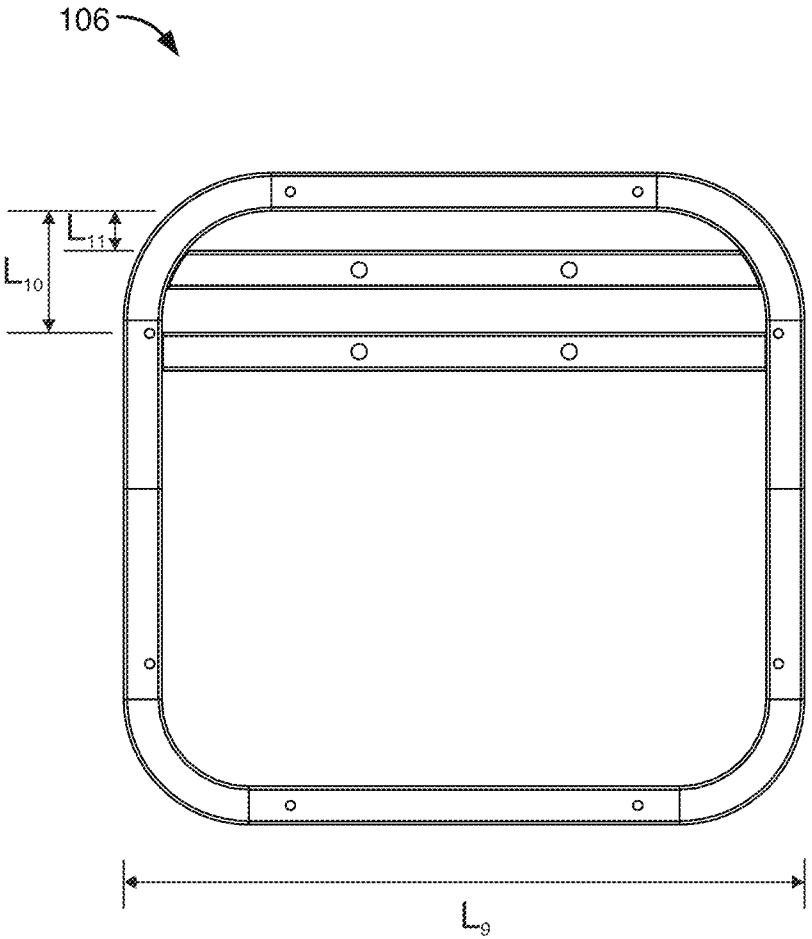
Figure 26C:
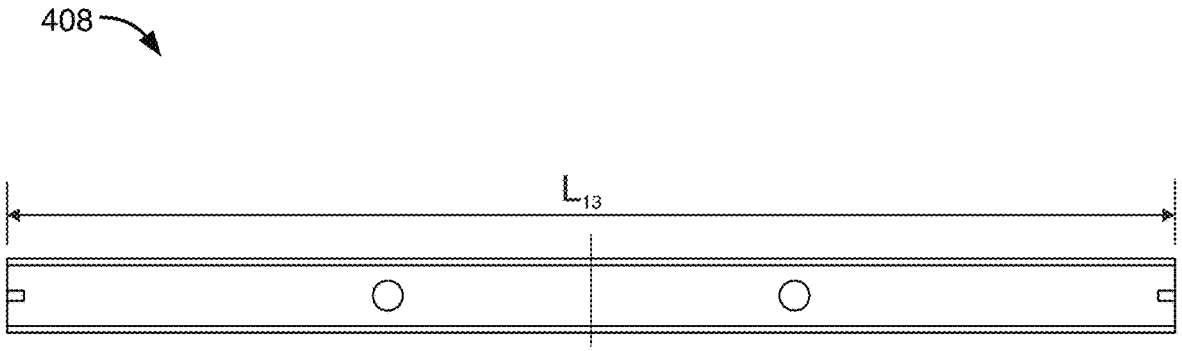
Figure 26D:
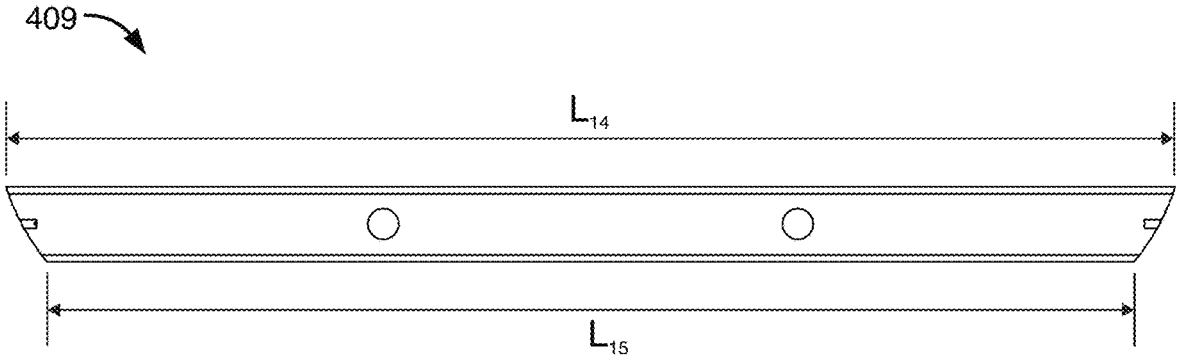

FIGS. 25A-25B show illustrative views of support slats 402, 404 and 406. Support slats 402, 404 and 406 may include dimensions. Table 16 lists the dimensions and corresponding ranges.

TABLE 16

Illustrative dimensions and corresponding ranges of support slats 402, 404 and 406.

| Illustrative dimensions | | | |
|---|---|---|---|
| Dimension | Lower limit (mm) | Upper limit (mm) | Example (mm) |
| $H_9$ | <1 | >50 | 30.0 |
| $L_7$ | <75 | >550 | 331.8 |
| $L_8$ | <75 | >550 | 356.0 |
| Other suitable dimension | Other suitable ranges | | Other suitable examples |

Edges of support slat 406 may be rounded to fit into backboard frame 104.

FIGS. 26A-26D show illustrative views of base frame 106. Base frame 106 may include dimensions. Table 17 lists the dimensions and corresponding ranges.

TABLE 17

Illustrative dimensions and corresponding ranges of base frame 106.

| Illustrative dimensions | | | |
|---|---|---|---|
| Dimension | Lower limit (mm) | Upper limit (mm) | Example (mm) |
| $W_8$ | <1 | >50 | 22.0 |
| $L_9$ | <75 | >500 | 392.0 |
| $L_{10}$ | <50 | >150 | 70.0 |
| $L_{11}$ | <10 | >100 | 23.0 |
| $L_{12}$ | <75 | >500 | 375.0 |
| $L_{13}$ | <75 | >500 | 347.0 |
| $L_{14}$ | <75 | >500 | 340.7 |
| $L_{15}$ | <75 | >500 | 316.7 |
| Other suitable dimension | Other suitable ranges | | Other suitable examples |

Figure 27:
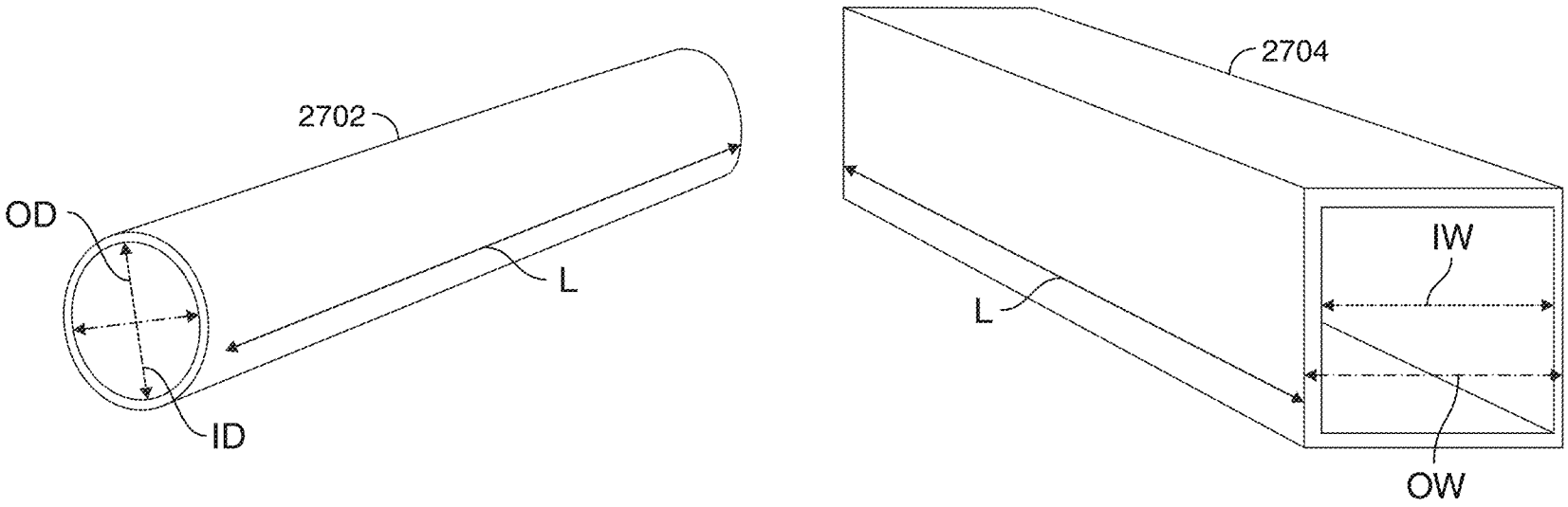
FIG. 27 shows illustrative apparatuses in accordance with principles of the disclosure.

FIG. 27 shows illustrative round tubing 2702 and illustrative square tubing 2704.

Round tubing 2702 may include outer diameter OD. Round tubing 2702 may include inner diameter ID. Outer diameter OD and inner diameter ID include any may include any suitable diameter as listed in Table 2a. Round tubing 2702 may include length L. Length L may be any suitable length.

Square tubing 2704 may include outer width OW. Square tubing 2704 may include inner width IW. Outer width OW and inner width IW may include any suitable width as listed in Table 2b. Square tubing 2704 may include length L. Length L may include any suitable length.

Figure 28A:
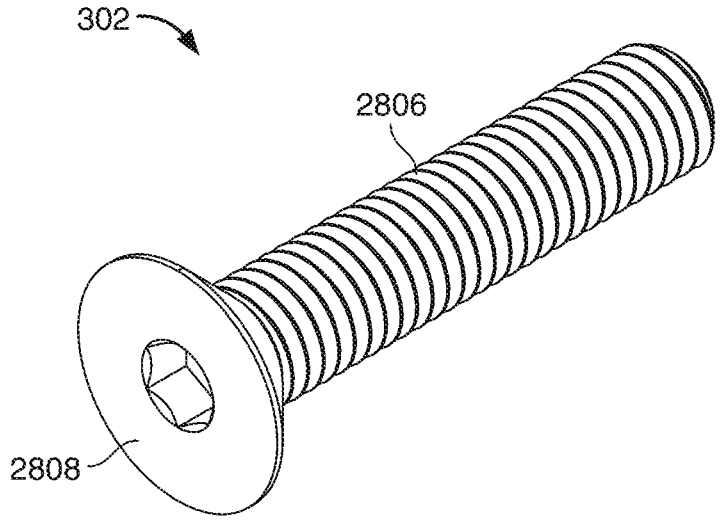
FIGS. 28A-28B show illustrative apparatuses in accordance with principles of the disclosure.

FIG. 28A shows illustrative screw 302. Screw 302 may include head 2808. Head 2808 may be hex socket countersunk head. Head 2808 may include any other suitable screw head. Screw 302 may include threads 2806. Threads 2806 may be male threads. Threads 2806 may be threaded through holes 1618 and 814.

Figure 28B:
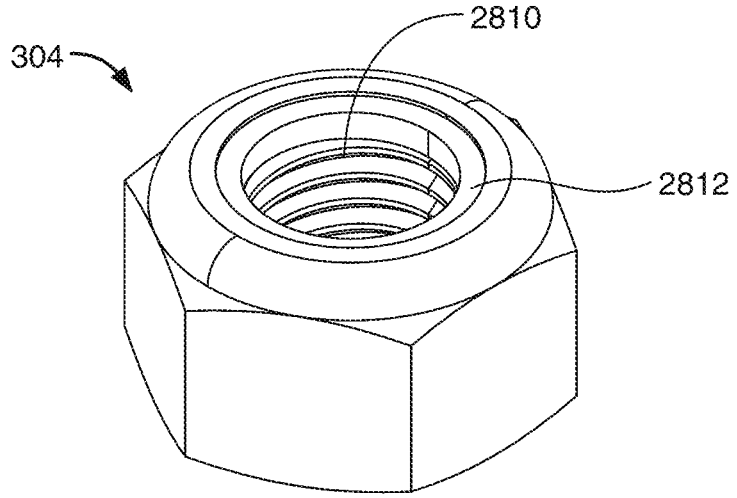

FIG. 28B shows illustrative nut 304. Nut 304 may include threads 2810. Threads 2810 may be female threads. Nut 304 may receive screw 302. Nut 304 may include nylon ring 2812. Nylon ring 2812 may resist vibration.

Figure 29:
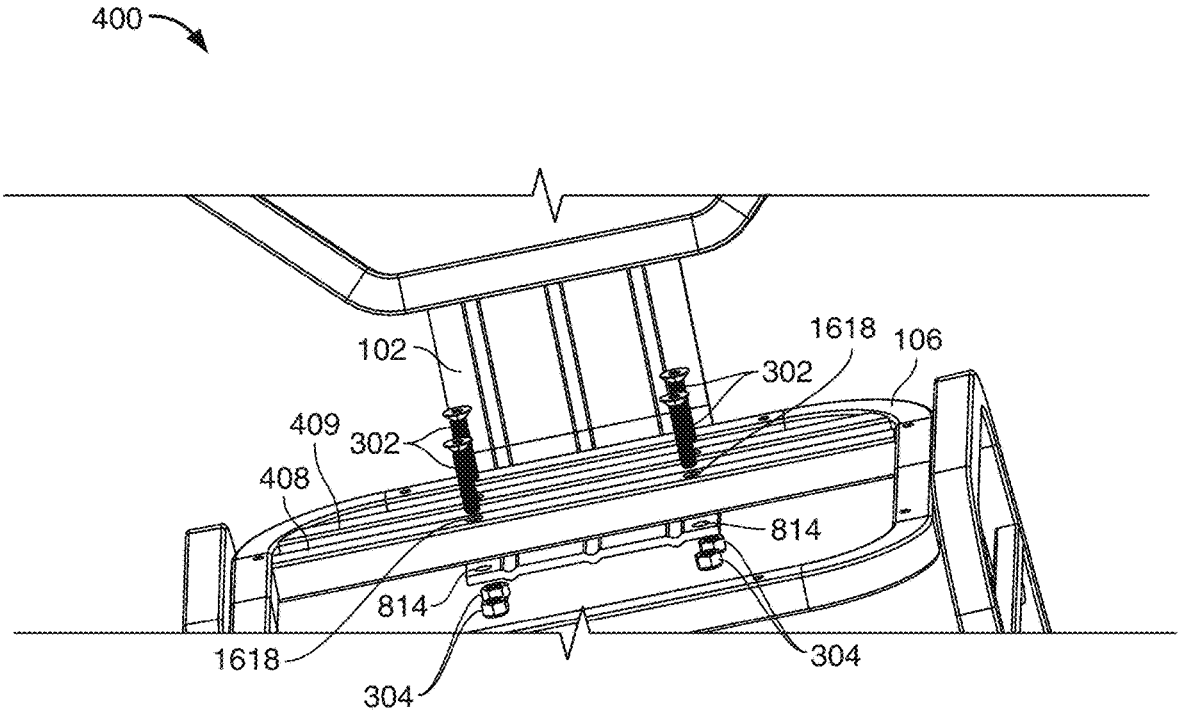
FIG. 29 shows illustrative apparatuses in accordance with principles of the disclosure.

FIG. 29 shows a partial front view of frame 400. Screws 302 may be screwed in through holes 1618 and holes 814. Screws 302 may be screwed into nuts 304.

One of ordinary skill in the art will appreciate that the steps shown and described herein may be performed in other than the recited order and that one or more steps illustrated may be optional. The methods of the above-referenced embodiments may involve the use of any suitable elements, steps, computer-executable instructions, or computer-readable data structures. In this regard, other embodiments are disclosed herein as well that can be partially or wholly implemented on a computer-readable medium, for example, by storing computer-executable instructions or modules or by utilizing computer-readable data structures. For example, methods for producing an apparatus may, in certain embodiments, be wholly or partially executed by designing the apparatus via software, such as computer aided design (CAD) software.

All ranges and parameters disclosed herein shall be understood to encompass any and all subranges subsumed therein, every number between the endpoints, and the endpoints. For example, a stated range of "1 to 10" should be considered to include any and all subranges between (and inclusive of) the minimum value of 1 and the maximum value of 10; that is, all subranges beginning with a minimum value of 1 or more (e.g. 1 to 6.1), and ending with a maximum value of 10 or less (e.g., 2.3 to 10.4, 3 to 8, 4 to 7), and finally to each number 1, 2, 3, 4, 5, 6, 7, 8, 9, and 10 contained within the range.

Thus apparatus, methods and systems for a FLEX-BACK BANQUET CHAIR are provided. Persons skilled in the art will appreciate that the present invention can be practiced by other than the described embodiments, which are presented for purposes of illustration rather than of limitation, and that the present invention is limited only by the claims that follow.

What is claimed is:

1. A flex-back banquet chair comprising:

a base frame configured to retain a seat assembly;

a lower support assembly configured to support the base frame, the lower support assembly comprising:

a first side frame comprising a first leg and a second leg, the first side frame is configured to be attached to a first side of the base frame;

a second side frame comprising a third leg and a fourth leg, the second side frame is configured to be attached to a second side of the base frame, the second side being opposite the first side; and a connector configured to connect the first side frame and the second side frame;

a backboard frame configured to retain a front backrest assembly and a back backrest assembly, the backboard frame including a plurality of support slats, each support slat extending from a first end of the backboard frame to a second end of the backboard frame, the first end being opposite the second end, the plurality of support slats configured to support the front backrest assembly and the back backrest assembly; and a flex bracket formed from sheet metal, the sheet metal bent at an angle, the flex bracket comprising:

a first mounting space extending along the flex bracket in a first direction;

a second mounting space; and three nerves, each nerve comprising an indentation in the sheet metal, each of the nerves extending from a bottom edge of the first mounting space in a direction that is orthogonal to the first direction; wherein:

the first mounting space is configured to be mounted onto a back side of the backboard frame;

the second mounting space is configured to be mounted onto an underside of the base frame; and when the first mounting space is mounted to the back side of the backboard frame and the second mounting space is mounted on the underside of the base frame, the backboard frame together with the first mounting space are configured to recline, in response to a force applied to the backboard frame, about a junction of the base frame and the second mounting space.

2. The flex-back banquet chair of claim 1 wherein the angle is about 104°.

3. The flex-back banquet chair of claim 1 wherein the angle is included in a range of about 100° to about 105°.

4. The flex-back banquet chair of claim 1 wherein the first mounting space is configured to be welded onto the back side of the backboard frame.

5. The flex-back banquet chair of claim 1 wherein the second mounting space is configured to be mounted onto the underside of the base frame via screws.

6. The flex-back banquet chair of claim 1 wherein each indentation is about 2 millimeters deep.

7. The flex-back banquet chair of claim 1 wherein each indentation is about 8 millimeters wide.

8. The flex-back banquet chair of claim 1 wherein the first mounting space has a height of about 1.5 centimeters.

9. The flex-back banquet chair of claim 1 wherein the flex-back banquet chair is configured to stack on top of a second flex-back banquet chair identical in structure to the flex-back banquet chair.

10. The flex-back banquet chair of claim 1 wherein the sheet metal includes steel.

11. The flex-back banquet chair of claim 1 wherein the plurality of support slats includes three supports slats.

12. The flex-back banquet chair of claim 1 wherein:

the base frame further includes:

a frame;

a first crossbeam welded to two opposite sides of the frame, the first crossbeam defining two holes, the two holes being included in a plurality of holes; and a second crossbeam welded to two opposite sides of the frame, the second crossbeam defining two holes, the second crossbeam being parallel to the first crossbeam, the two holes being included in the plurality of holes; and the second mounting space defines four holes, each of the four holes corresponding to a hole included in the plurality of holes; wherein the flex bracket is configured to be mounted to an underside of the base frame by mounting the flex bracket to the first crossbeam and second crossbeam via screwing bolts, through each of the four holes.

13. The flex-back banquet chair of claim 1 wherein the sheet metal has a thickness of about 8.1 millimeters.

14. A flex-back banquet chair comprising:

a base frame configured to retain a seat assembly;

a lower support assembly configured to support the base frame, the lower support assembly comprising:

a first side frame comprising a first leg and a second leg, the first side frame welded to a first side of the base frame;

a second side frame comprising a third leg and a fourth leg, the second side frame welded to a second side of the base frame, the second side being opposite the first side; and a connector connecting the first side frame and the second side frame independent of a connection of the first side frame and the second side frame via the base frame;

a backboard frame configured to retain a front backrest assembly and a back backrest assembly, the backboard frame including a plurality of support slats, each support slat extending from a first end of the backboard frame to a second end of the backboard frame, the first end being opposite the second end, the plurality of support slats configured to support the front backrest assembly and the back backrest assembly; and a flex bracket formed from sheet metal, the sheet metal bent at an angle of about 104°, the flex bracket comprising:

a first mounting space extending along the flex bracket in a first direction, the first mounting space having a height of about 1.5 centimeters;

a second mounting space; and three nerves, each nerve comprising an indentation in the sheet metal, each of the nerves being about 2 millimeters deep and about 8 millimeters wide, each of the nerves extending from a bottom edge of the first mounting space in a direction that is orthogonal to the first direction;

wherein:

the first mounting space is welded onto a back side of the backboard frame;

the second mounting space is mounted to an underside of the base frame; and when the first mounting space is welded to the back side of the backboard frame and the second mounting space is mounted on the underside of the base frame, the backboard frame together with the first mounting space are configured to recline, in response to a force applied to the backboard frame, about a junction of the base frame and the second mounting space.

15. The flex-back banquet chair of claim 14 wherein the flex-back banquet chair is configured to stack on top of a second flex-back banquet chair identical in structure to the flex-back banquet chair.

16. The flex-back banquet chair of claim 14 wherein the sheet metal includes steel.

17. The flex-back banquet chair of claim 14 wherein the plurality of support slats includes three support slats.

18. The flex-back banquet chair of claim 14 wherein:

the base frame further includes:

a frame;

a first crossbeam welded to two opposite sides of the frame, the first crossbeam defining two holes, the two holes being included in a plurality of holes; and a second crossbeam welded to two opposite sides of the frame, the second crossbeam defining two holes, the second crossbeam being parallel to the first crossbeam, the two holes being included in the plurality of holes; and the second mounting space defines four holes, each of the four holes corresponding to a hole included in the plurality of holes;

wherein the flex bracket is configured to be mounted to an underside of the base frame by mounting the flex bracket to the first crossbeam and second crossbeam via screwing bolts, through each of the four holes.

19. The flex-back banquet chair of claim 14 wherein the sheet metal has a thickness of about 8.1 millimeters.

20. A flex-bracket comprising:

sheet metal bent at an angle;

a first mounting space extending along the sheet metal in a first direction;

a second mounting space; and three nerves, each nerve comprising an indentation in the sheet metal, each of the nerves extending from a bottom edge of the first mounting space in a direction that is orthogonal to the first direction;

wherein:

the first mounting space is configured to be welded onto a back side of a backboard frame of a banquet chair;

the second mounting space is configured to be mounted to an underside of a base frame of the banquet chair; and when the first mounting space is mounted to the back side of the backboard frame and the second mounting space is mounted on the underside of the base frame, the backboard frame together with the first mounting space are configured to recline, in response to a force applied to the backboard frame, about a junction of the base frame and the second mounting space.

* * * * *